United States Patent [19]

Szarka

[11] 4,176,601

[45] Dec. 4, 1979

[54] AUTOMATED TOWEL TRANSFER PRINTING, FEEDING, DRYING AND FOLDING APPARATUS

[75] Inventor: Sandor Szarka, Franklin Lakes, N.J.

[73] Assignee: Precision Screen Machines, Inc., Hawthorne, N.J.

[21] Appl. No.: 810,375

[22] Filed: Jun. 27, 1977

[51] Int. Cl.[2] ..... B41F 15/12

[52] U.S. Cl. ..... 101/115; 101/118; 198/435; 198/473; 198/493; 198/680; 271/312

[58] Field of Search ..... 101/123, 124, 126, 118, 101/115; 198/688, 692, 493, 495, 473, 681, 680, 435, 436, 440; 271/DIG. 2, 174

[56] References Cited

U.S. PATENT DOCUMENTS

| | | | |
|---|---|---|---|
| 2,887,211 | 5/1959 | Myers | 198/681 |
| 3,129,442 | 4/1964 | Leckie | 101/126 X |
| 3,308,750 | 3/1967 | Voegelin | 101/126 |
| 3,321,066 | 5/1967 | Christianson | 198/692 |
| 3,472,354 | 10/1969 | Locatelli | 198/681 X |
| 3,677,538 | 7/1972 | Wall | 271/DIG. 2 |
| 3,819,175 | 6/1974 | Borastyan | 271/DIG. 2 |
| 3,850,285 | 11/1974 | Johnson | 198/680 |

FOREIGN PATENT DOCUMENTS

| | | | |
|---|---|---|---|
| 32503 | 4/1962 | Finland | 198/435 |

*Primary Examiner*—Paul T. Sewell

[57] ABSTRACT

A conveying system adapted for use with a screen printing machine having an endless printing blanket for supporting and indexing a work piece during a screen printing operation. The system includes transfer apparatus disposed adjacent the discharge end of the indexing printing blanket which includes removing apparatus in the form of belt strips having gripping pins to peelingly remove the work piece from the printing blanket. Elevating apparatus for first lifting the leading edge of the work piece away from the printing blanket so as to suspend the leading edge until the work piece is advanced in a position for engagement by the gripping pins is provided such that the leading edge bridges any spacing between the discharge end of the printing blanket and the removing apparatus. The transfer apparatus also includes discharge apparatus which is disposed adjacent the belt strips for receiving the work piece therefrom with stripper apparatus interposed in the spaces between the belt strips to separate and facilitate the transfer of the work piece from the belt strips to the discharge apparatus. The invention further contemplates transporting apparatus operated in conjunction with a dryer conveyor section for effecting the transfer of the work piece thereto for conveyance of a work piece through a dryer. The drive of the transporting apparatus is activated in timed relationship to the drive of the discharge apparatus to provide the transfer of the work piece from the discharge apparatus to the dryer conveyor.

80 Claims, 20 Drawing Figures

80
32
12
92
72
70
92
102
82
94
84
124
86
106
124
88
92
114
18
32
88
122
12
126
32
108
110
120
72
30
96
90
20
166
98
164
154
32
104
152
140
118
116
146
160
162
158

94
100
75°
98
96
86

AUTOMATED TOWEL TRANSFER PRINTING, FEEDING, DRYING AND FOLDING APPARATUS

BACKGROUND OF THE INVENTION

The present invention pertains to new and novel apparatus, and systems for use in conjunction with screen printing equipment in order to provide automated transfer from the printing equipment to obtain a drying of the work piece and transfer to a collecting station.

In screen printing various articles, e.g., towels and various other types of discrete forms, it was heretofore necessary to adhesively secure the towel or work piece to be printed onto a movable printing blanket for indexing the work piece from station to station during the printing operation. The need for adhesively securing the work piece to the surface of the printing blanket is to insure accurate registration of the work piece relative to the printing screen, by prohibiting any movement thereof which would otherwise upset the registration of the design being printed.

Heretofore, difficulty has been encountered in peeling off or removing the adhesively secured printed article from the printing blanket as the printing blanket rounded the end roller on which it is mounted. Generally the act of peeling off the printed article from the printing blanket was performed manually by an operator standing adjacent the discharge end of the machine. As such printing blanket is generally intermittently operated, the operator would manually peel off the endmost article at the discharge end of the machine during the stop interval of the blanket.

Depending on the indexing and/or size of the article being printed, it frequently required an operator to lean extremely forward, over the end of the machine, to peel the article from the blanket. Also, due to the operating speed of the machine, the time interval between successive prints may be too short to permit manual stripping of the article from the printing blanket. For these reasons considerable difficulty has been encountered in the art for effecting automatic removal of the printed work piece which has been adhesively secured to the printing blanket.

OBJECTS OF THE INVENTION

Accordingly, it is the primary object of the present invention to provide new and novel apparatus for use with a screen printing machine having a movable printing blanket, the apparatus including transfer means which is operative to automatically peel or strip the printed article from the blanket without interfering with the printed portion thereof which may be still wet.

It is another object of the present invention to provide transfer apparatus which is synchronized to the drive of the screen printing blanket and which continues to effect the advances of the work piece even though the movement of the printing blanket is rendered intermittent.

It is yet a further object of the present invention to provide elevating means for first lifting the leading edge of a work piece away from a printing blanket to which it may be adhesively secured and thereafter processed through a drying oven.

It is still a further object of the present invention to provide in a printing system discharge apparatus for automatically removing into a folded position a work piece and thereafter transporting the supported work piece through a drying oven on dryer conveyor means.

It is yet a further object of the present invention to provide releasing apparatus to automatically remove the work piece at the end of the drying oven for depositing the work piece at a collecting station.

It is yet a further object of the present invention to provide a total printing and processing system such that the work piece once positioned on a printing blanket is thereafter automatically printed and dried and thereafter released or deposited at a work station.

It is still another object of the present invention to provide a system that is fully automated for processing flexible work pieces, such as towels or the like, in which the transfer from the printing station to the dryer is automatically accomplished in a timed sequence of operations.

It is yet another object of the present invention to provide apparatus for transporting a work piece from a conveyor belt to a dryer in a manner to support the work piece in a folded position as it is traveling through the dryer.

Other objects and advantages of the present invention will become apparent as the disclosure proceeds.

SUMMARY OF THE INVENTION

The outstanding and unexpected results obtained by the apparatus of this invention are obtained by a series of features, and elements assembled and working together in interrelated combination.

The present invention provides apparatus for use in combination with a screen printing machine having an endless movable printing blanket with a discharge end upon which a work piece to be screen printed is adhered. The apparatus comprises transfer means disposed adjacent to the discharge end of the movable printing blanket for effecting the movement of the work piece from the printing blanket to the transfer means. The transfer means includes elevating means for first lifting the leading edge of the work piece away from the printing blanket so as to suspend the leading edge until the work piece is advanced in a position for engagement by the transfer means such that the leading edge bridges any spacing between the discharge end of the printing blanket and the transfer means.

Removing means is provided as part of the transfer means and includes a series of spaced apart endless conveyor belt strips operatively associated with the elevating means. Gripping means is formed on the surface of the series of spaced apart endless belt strips for gripping the work piece and peeling and stripping the work piece adhered to the printing blanket to effect the transfer of the work piece from the printing blanket to the series of endless belt strips. The gripping means first engages the leading edge suspended by the elevating means.

The endless takeoff removing means includes a series of belt strips that function to automatically strip the printed work piece which has generally been adhesively secured to the printing blanket and to convey the printed work piece away from the indexing blanket. The drive of the transfer means is synchronized to the drive of the printing blanket by first drive means. The invention further contemplates second drive means to effect a continuous movement of the removing means even though the drive of the printing blanket is rendered intermittent.

Accordingly, the first drive means drives the endless belt strips in timed relationship to the printing blanket such that during the relative movement therebetween the elevating means lifts the leading edge of the work piece and causes the gripping means to peel and strip the work piece from the printing blanket.

The transfer means further comprises discharge means disposed adjacent the belt strips for receiving the work piece therefrom and having stripper means interposed in the spaces between the belt strips to separate and facilitate the transfer of the work piece from the belt strips to the discharge means. The stripper means includes a plurality of elongated plates, each one of the plates having an upper surface and mounted in the spaces between the belt strips. The plates are angularly disposed relative to the belt strips so as to support the work piece thereon as the belt strips move below the upper surface of each of the plates.

The discharge, means in accordance with one embodiment of the invention, comprises an endless flexible discharge conveyor belt mounted over a pair of oppositely disposed inner and outer support rollers in spaced relationship to each other. The inner support roller is mounted in spacially fixed relationship to the removing means, and reciprocation means is operatively associated with said outer support roller for reciprocal movement of the outer support roller in a direction towards and away from the inner support roller such that the outer end of the discharge conveyor belt extending over the outer roller is reciprocated in timed relationship to the movement of the work piece along the discharge conveyor belt.

Transporting means is interposed between the discharge means and the dryer conveyor means. The transporting means includes a series of carrier bars disposed at spaced intervals with control means for effecting the intermittent drive of the carrier bars. The control means effecting the intermittent drive of the transporting means when the work piece is disposed on the discharge conveyor belt in a position to be readily removed therefrom by one of the carrier bars.

Accordingly, the sequence of operation is such that the work piece is removed from the printing blanket by the removing means and thereafter progressively positioned on the discharge means which is in the form of a continuous flexible belt. This permits the support surface of the discharge conveyor belt to change in dimension. The dimensional change permits the carrier bar to be brought into position behind a work piece such that when the work piece is draped over and extends below the discharge conveyor belt, the carrier bar may be readily brought into position to remove the work piece from the discharge conveyor belt.

Supporting means is utilized in conjunction with a carrier bar to prevent backlash of the work piece which is still wet. The supporting means may include at least one support bar extending transversely across the discharge conveyor belt, and below the carrier bar. This support bar facilitates the transfer of the work piece to the carrier bar. Each carrier bar is then transported to dryer conveyor means disposed adjacent to the transporting means. The carrier bar then passes through a drying oven or tunnel to dry the work piece.

Another novel feature of the present invention is that there is provided releasing means at the end of the dryer conveyor means so as to cause the work piece to be automatically released from its positionment on the carrier bar. In this manner there is a saving in that manual labor need not be utilized for removing the dried work pieces.

The complete printing system is synchronized such that the respective sequence of movement of the work piece therethrough automatically takes place. The only labor required is the initial positionment of the work piece on the printing blanket. Means for adhesively securing the work piece to the printing blanket provides the necessary registration for the printing and subsequent steps carried out by the apparatus of the present invention.

BRIEF DESCRIPTION OF THE DRAWINGS

The foregoing and other objects, features, advantages and utilizations of the new and novel printing system of the present invention will become more apparent from the detailed description hereinafter considered in conjunction with the accompanying drawings, wherein.

DETAILED DESCRIPTION OF THE PREFERRED EMBODIMENTS

Figure 1:
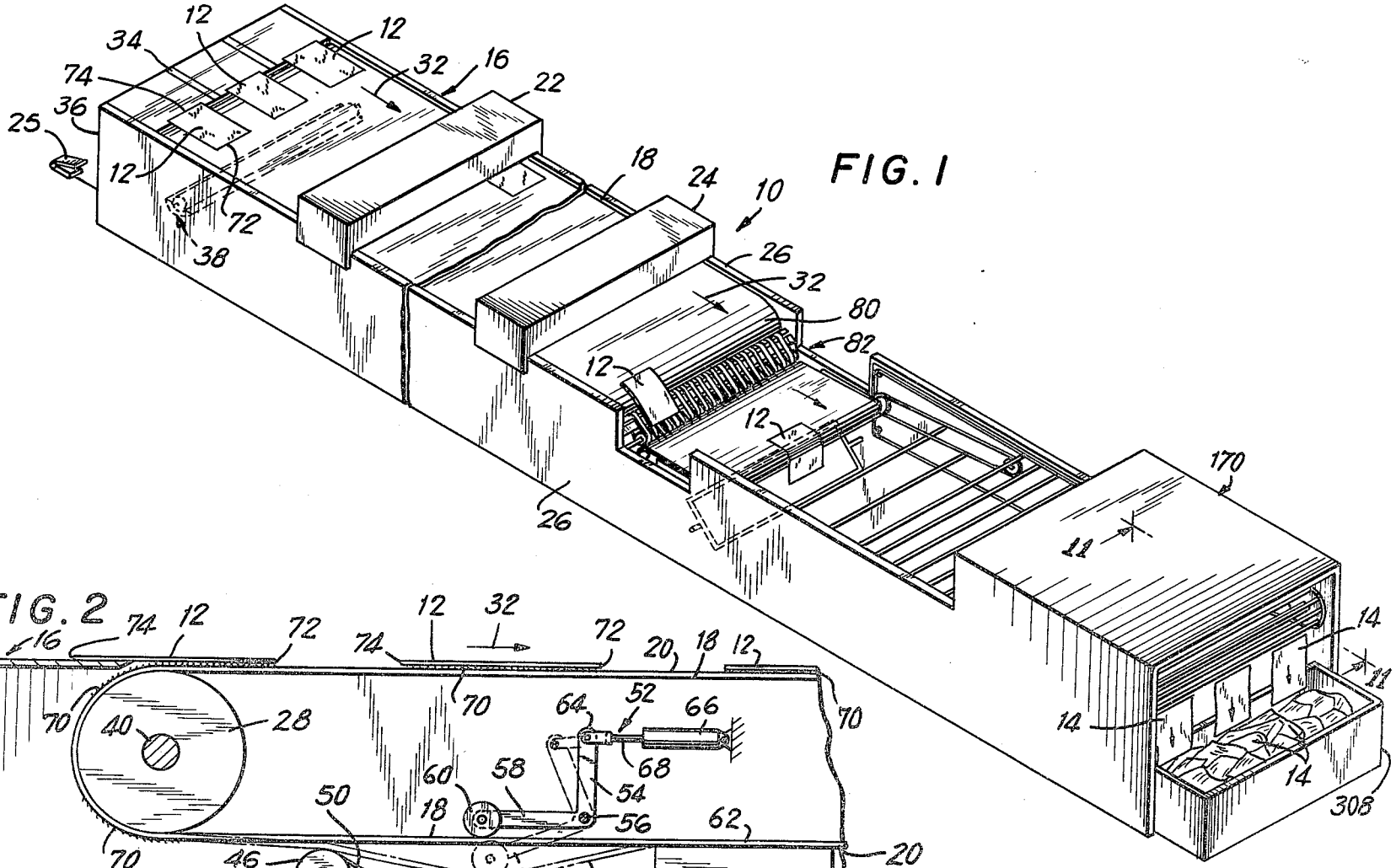
FIG. 1 is a perspective view of a printing system embodying the various novel aspects of the present invention.

Referring now to FIGS. 1 through 14, there is illustrated a total system or apparatus 10 that is utilized to process a work piece 12 through a series of steps in order to obtain a finished work piece as identified by numeral 14. The apparatus or system 10, as illustrated in FIG. 1, utilizes a series of sub-assemblies that provide for an in line processing system that is completely automatic to move the work piece 12 through various stages of processing until the completed work piece 14 is obtained.

The apparatus 10 includes at one end thereof screen printing apparatus 16 which may be of a type well known in the art, and includes an endless indexing or printing blanket 18 having an upper surface 20 on which the work piece 12 is supported. The screen printing apparatus 16, which may be of the type disclosed in U.S. Pat. No. 3,357,350, provides for the indexing of the work piece 12 from a first printing station 22 to a second printing station 24 to effect the screen printing on the work piece 12.

As illustrated in FIG. 1, the screen printing apparatus 20 16 may be of a width to accommodate three work pieces 12 simultaneously for processing through the apparatus 10. To maintain the registration of the work piece 12, i.e. a towel or the like, with respect to the printing screen stations 22 and 24, the work piece 12 is adhesively secured to the surface 20 of the printing blanket 18. A foot pedal 25 may be utilized to stop the movement of the printing blanket 18, if required, by the operator.

Figure 2:
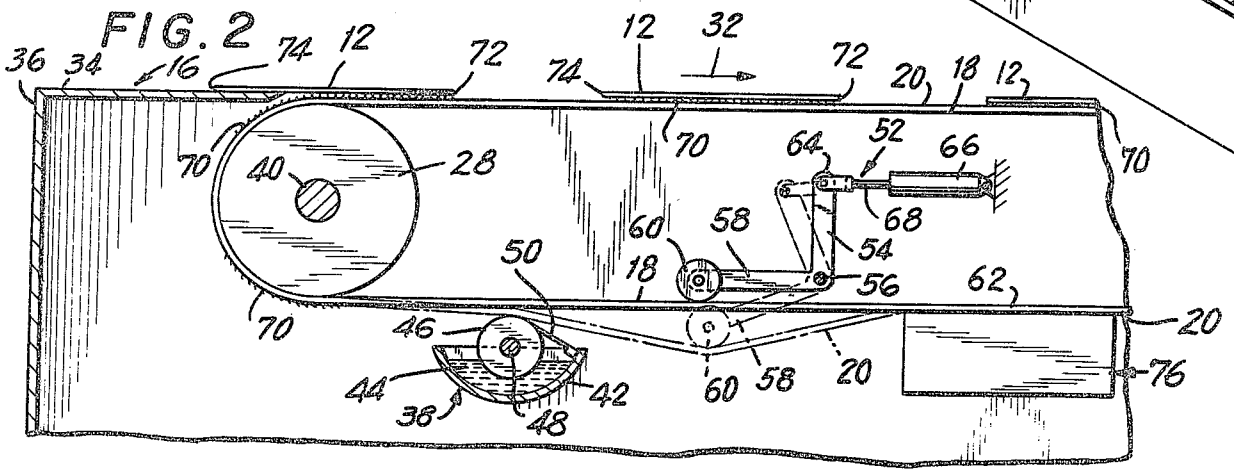
FIG. 2 is an enlarged fragmentary diagrammatic view illustrating the apparatus for applying adhesive to the printing blanket in order to temporarily secure a work piece thereto.
Figure 3:
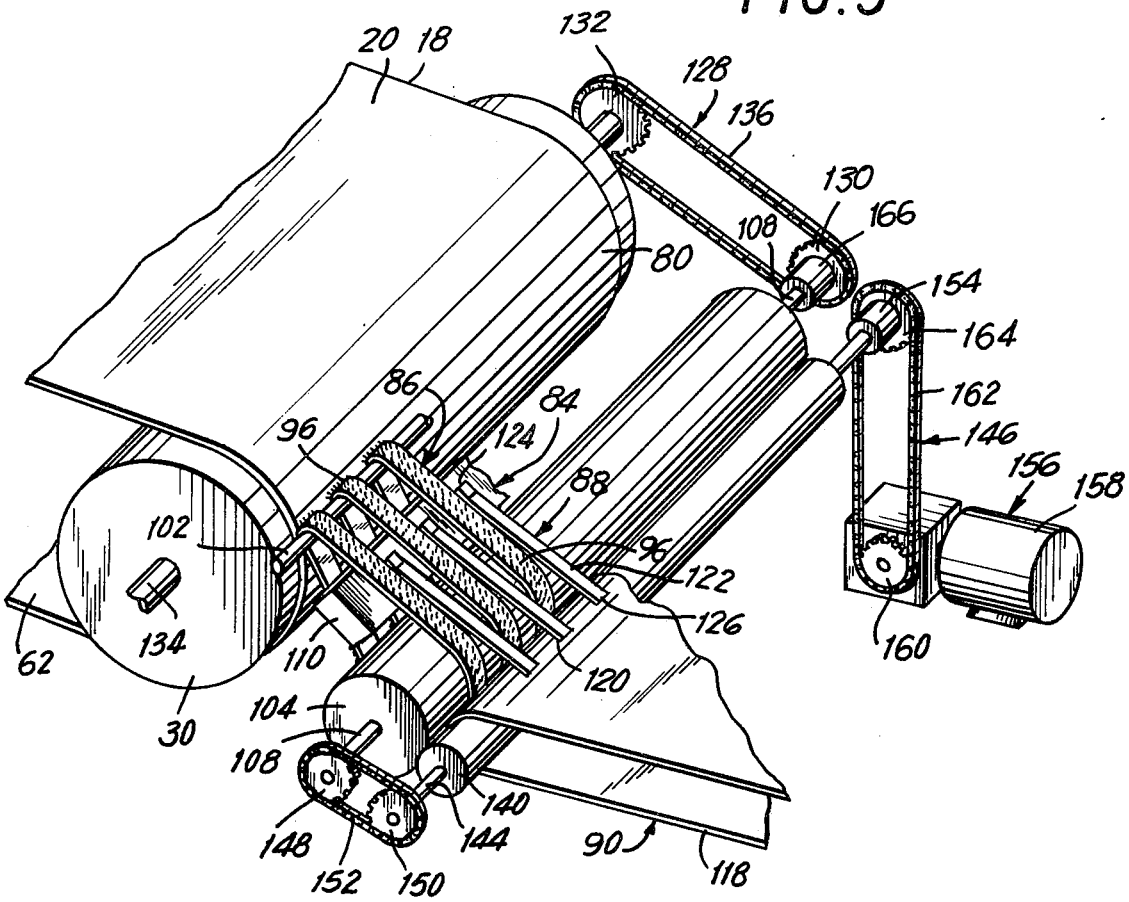
FIG. 3 is a perspective view illustrating the transfer means for removal of a work piece from the printing blanket.

The apparatus 10 may include spaced apart vertically extending side panels 26 between which there is mounted the various sections as hereinafter described in detail. It is appreciated that the various sections of the apparatus 10 may be utilized and have application in various types of systems, but the invention is being primarily illustrated with the sections operative in combination with each other. The printing blanket 18 is supported and extends over spaced apart roller 28, as illustrated in FIG. 2, and spaced apart roller 30, as illustrated in FIG. 3. The rollers 28 and 30 are driven in synchronized relationship on an intermittent basis to move each work piece 12 in the direction of the single headed arrow 32 illustrated in FIG. 1.

As illustrated in FIG. 2, the screen printing apparatus 16 includes a support platform 34 which extends in a horizontal plane at the front end 36 of the assembly 10. The horizontal plane defined by the support platform 34, is as the same level as the upper surface 20 of the printing blanket 18. Adhesive applying means 38, as illustrated in FIG. 2, is positioned below the roller 28 and intermediate the spacing defined by the diameter of roller 28. Roller 28 is mounted on shaft 40 and is rotatably journalled between the side panels 26. The printing blanket 18 is sufficiently flexible such that it may be deflected in the manner illustrated in FIG. 2. The applying means 38 for intermittently coating selective portions of surface 20 of printing blanket 18 includes a reservoir 42 having an adhesive fluid 44 contained therein with a transfer roller 46 rotatably mounted on shft 48 so as to pass through the fluid 44.

The transfer roller 46 has a doctoring blade 50 mounted adjacent thereto in order to maintain the proper layer of adhesive 44 thereon. Engaging means 52 forms part of the applying means 38 and is utilized to bring the surface 20 of the printing blanket 18 into pressured engagement or contact with the transfer roller 46. The engaging means 52 includes an engaging arm 54 pivotally mounted to be angularly displaced around pin 56. One end 58 of the engaging arm 54 has a roller member 60 to engage the inner surface 62 of the printing blanket 18. The other end 64 of the engaging arm 54 is coupled to piston 66 having a piston shaft 68 coupled to the end 64 of the engaging arm 54.

In operation the movement of shaft 68 is sequenced in timed relationship to the processing of the work piece 12 through the apparatus 10. In the extended position the arm 54 is brought into the position illustrated in phantom in FIG. 2, so as to deflect the printing blanket 18 a sufficient distance to obtain the necessary engagement between the transfer roller 46 and the surface 20. This position is continued for a period of time related to the speed of movement of the printing blanket 18 in order to obtain the adhesive layer or coating 70 which is substantially equal in dimension to the length of the work piece between the front or leading end 72 and oppositely spaced apart rear end 74 except for a predetermined length of the leading end 72. Obviously, the length of the adhesive layer 70 may be varied depending upon the size of the work piece 12 being processed.

The applying means 38 has mounted relative thereto cleansing means 76, which is illustrated in FIG. 2, to have the surface 20 of the printing blanket 18 extend thereacross. The cleansing means 78 provides the necessary washing of the printing blanket 18 subsequent to the applying means 38 placing on the surface 20 the coating 70. The washing process provided by the cleansing means 76, which may contain cleaning rollers (not shown) provides the necessary cleaning of the surface 20, and in actuality is performed after a complete cycle and prior to the reapplication of coating 70 upon surface 20.

The screen printing machine 16 performs the necessary printing operation on each work piece 12. The printing blanket 18 moves in the direction of arrow 32 such that there is a discharge end 80 which substantially coincides with the printing blanket 18 rounding the roller 30 in the direction of arrow 32, as illustrated in FIG. 5.

In accordance with the present invention transfer means 82 is disposed adjacent to the discharge end 80 of the movable printing blanket 18 for effecting the movement of the work piece 12 from the printing blanket 18 to the transfer means 82. The transfer means 82, as more particularly illustrated in FIGS. 3, 4, and 5, includes elevating means 84 which is utilized for first lifting the leading edge 72 of the work piece 12 away from surface 20 of the printing blanket 18.

Removing means 86 is utilized in conjunction with the elevating means 84 in order to provide for the removal of the work piece 12 from the printing blanket 18. Once the work piece 12 has been transported to the removing means 86, it is thereafter processed through the apparatus 10 by utilization of stripper or guide means 88 and discharge means 90.

Figures 5, 5A:
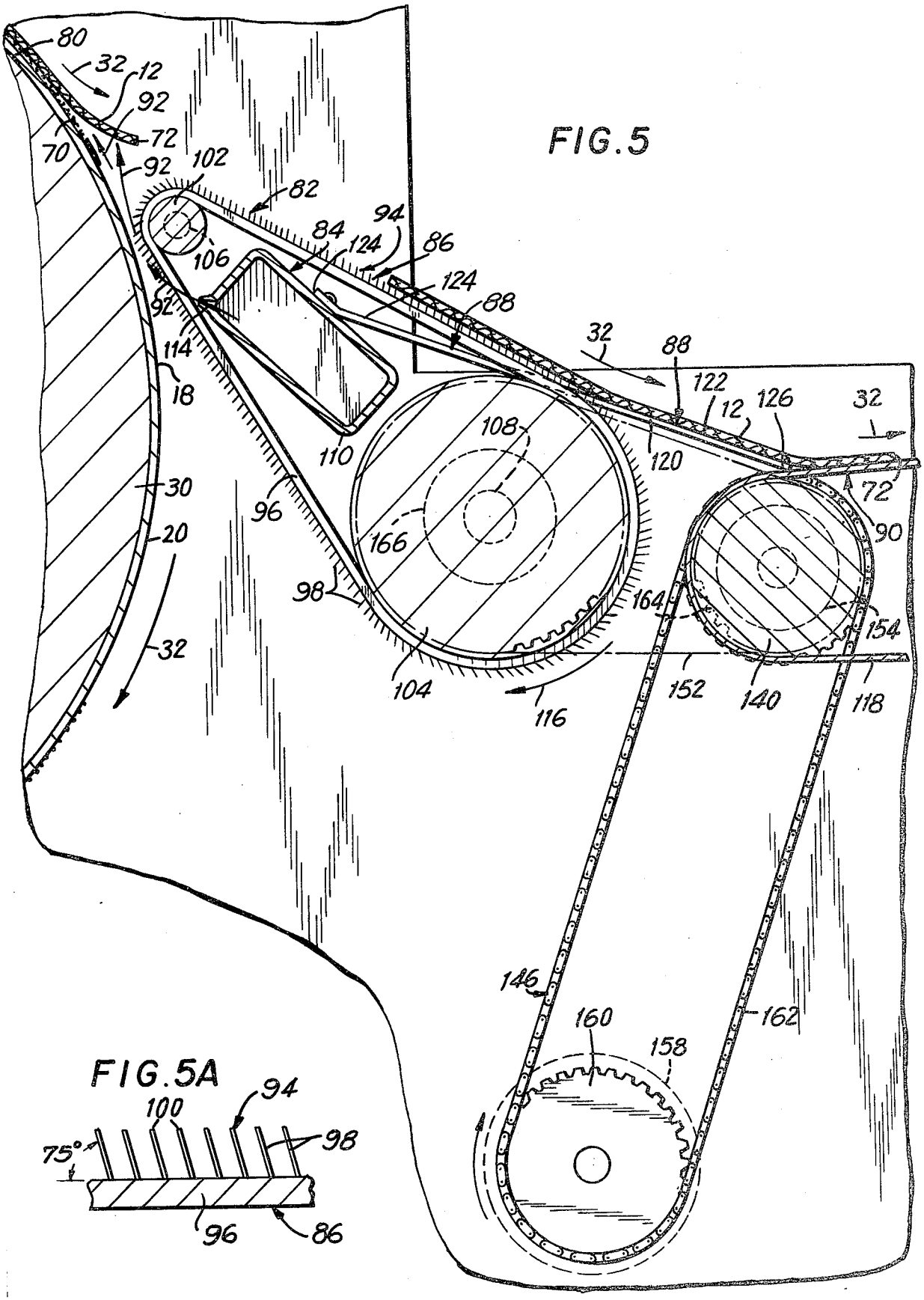
FIG. 5 is an enlarged detailed cross-sectional view of the discharge means taken along line 5—5 of FIG. 4.
FIG. 5A is an enlarged fragmentary sectional view of the gripping means associated with the transfer means taken on the line 5A—5A of FIG. 4.

The elevating means 84 is utilized to separate the unsecured leading edge 72 of the work piece 12, in the case of towels, the front portion, by applying a force (air pressure) in the direction indicated by arrows 92 in FIG. 5. This force, as indicated by arrows 92, is sufficient to lift or elevate the leading edge 72 of the work piece 12. The elevating means 84 includes fluid means extending below the gripping means 94 which are formed on the removing means 86.

The removing means 86 may be in the form of a series of spaced apart endless belt strips 96 operatively associated with the elevating means 84. The gripping means 94 is formed on the surface of the series of spaced apart endless belt strips 96 for gripping the work piece 12 and peeling and stripping the work piece 12 adhered to the upper surface 20 of the printing blanket 18 to effect the transfer of the work piece 12 from the printing blanket 18 to the series of endless belt strips 96. The gripping means 94 first engages the leading edge 72 suspended or lifted by the elevating means 84.

The gripping means 94 comprises a plurality of needle-like elements 98 disposed in a substantially vertical plane having pointed tips 100 to define a gripping surface so as to engage and cause a pulling force to be transmitted to the work piece 12 in the direction of travel of the printing blanket 18, as indicated by arrow 32. The needle-like elements 98 are inclined at an acute angle relative to the direction of travel of the endless belt strips 96. The acute angle is approximately 75 degrees, as illustrated in FIG. 5A. The endless belt strips 96 are substantially equidistantly spaced from one another.

The series of belt strips 96 are mounted for rotation on a pair of spaced apart belt rollers 102 and 104 journalled respectively on shafts 106 and 108. The belt rollers 102 and 104 extend transversely across the width of the printing blanket 18. The belt roller 104 has a larger diameter than the belt roller 102 so as to provide space therebetween for positionment of the elevating means 84.

The elevating means 84 includes a conduit 110 that is normally sealed and has an entrance port or opening 112 for the delivery of fluid under pressure, generally air, which is directed through a plurality of spaced apart ports 114 against the surface 20 of printing blanket 18 in the direction of arrows 92. The ports 114 are positioned intermediate each pair of belt strips 96 so as to in effect provide a blanket of air across the width of the printing blanket 18. In this manner as the leading edge 72 of the work piece 12 reaches the position illustrated in FIG. 5, the force of the air currents lifts the leading edge 72 above the surface 20. Concurrently with this occurring, the printing blanket 18 is progressively moving forward and the belt strips 96 are moving in the direction of arrow 116. The leading edge 72 remains suspended for the period of time necessary to extend into overlapping engagement with the needle-like elements 98. When this occurs, the weight of the work piece 12 is such that it lowers itself onto the tips 100 such that a pulling force is exerted which is sufficient to provide for the transfer from the printing blanket 18 to the series of belt strips 96. Accordingly the width of each belt strip or doffer strip 96 is related to the size of the work pieces 12 to be processed through the apparatus 10.

Accordingly, the elevating means 84 provides for the necessary lifting of the forward end 72 of the work piece 12 in order to bridge the gap or spacing between the belt strips 96 and the printing blanket 18. The supply of fluid into the entrance opening 112 from a source (not shown) may be on a continuous basis, notwithstanding the belt strips moving at different or variable speeds.

In the continuous processing of each work piece 12 there is provided discharge means 90 disposed adjacent to the belt strips 96 for receiving the work piece 12 therefrom. The discharge means 90 includes an endless flexible discharge conveyor belt 118. The stripper or guide means 88 is interposed in the spaces between the belt strips 96 to separate and facilitate the transfer of the work piece 12 from the belt strips 96 to the discharge means 90. The stripper means 88 includes a plurality of elongated plates 120, each of which has an upper surface 122 and which are mounted in the spaces between the belt strips 96. The plates 120 are angularly disposed relative to the belt strips 90 so as to support the work piece 12 thereon as the belt strips 96 move below the upper surface 122 of each of the plates 120.

The plates 120 may have one end thereof 124 mounted to conduit 110 and the opposite or free end 126 thereof may rest or be positioned adjacent to the discharge conveyor belt 118. In this manner the propelling force of the belt strips 96 provide ample momentum as the needle-like elements 98 are being withdrawn from engagement with the work piece 12 to bridge the distance and have the leading edge 72 of the work piece brought into engagement with the discharge conveyor belt 118 such that the transfer from the removing means 86 to the discharge means 90 is easily and satisfactorally accomplished.

To obtain the controlled movement between the belt strips 96 and printing blanket 18 in timed relationship to each other, a first drive means 128 is provided. The first drive means 128 may include a sprocket 130 mounted at one end of shaft 108 and a sprocket 132 mounted on shaft 134 supporting roller 30. An endless drive chain 136 is coupled therebetween. In this manner roller 30 and belt roller 104 may be driven at the same speed.

The endless flexible discharge conveyor belt 118 is mounted upon a pair of oppositely disposed inner and outer support rollers 140 and 142, respectively. The inner support roller 140 is mounted in spatially fixed relationship to the removing means 86, and particularly belt roller 104. Support shaft 144 is linked to support shaft 108 by means of second drive means 146, sprockets 148, 150 and drive chain 152. The drive means 146 is connected in driving relationship to roller 140 to effect the drive of the removing means 86 independently of the first drive means 128 such that the first drive means 128 can overdrive the second drive means 146.

The first drive means 128 is interconnected between printing blanket 18 through roller 30 and in turn by means of drive chain 136 to the belt roller 104. Shafts 108 and 144 are provided with pulleys or sprockets 148 and 150, respectively. Sprockets 148 and 150 may be coupled directly to each other by drive chain 152 or an idler gear mounted therebetween.

The printing blanket 18 is intermittently advanced relative to the printing screen stations 22 and 24. During those periods of time that the printing blanket 18 comes to a complete rest or stop, movement of the transfer means 82 continues, but at a slower speed than the printing blanket 18. To provide the synchronized movement, a one-way driving clutch 154 is suitably coupled to the shaft 144. Drive means 156 in the form of an electric motor is suitably coupled to sprocket 160 which is coupled via drive chain 162 mounted on sprocket 164. In this driving relationship, when motor 158 is powered, it will in turn drive belt roller 104 by means of the sprockets 148 and 150 which are coupled by drive chain 152. A second one-way clutch 166 is mounted on shaft 108 and is in turn coupled to sprocket 130. The one-way clutches 154 and 166 permit the driving of the inner support roller 140 and belt roller 104 at a preselected speed even when the roller 30 has stopped.

Figure 14:
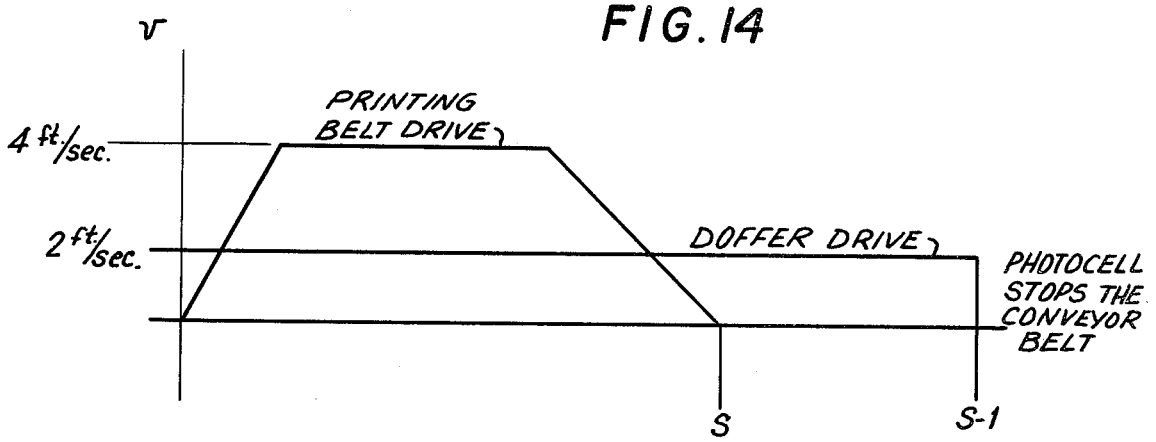
FIG. 14 is a graph helping to illustrate the relative movement between the printing blanket and the transfer means.

In the manner illustrated in FIG. 14, motor 158 is designed to drive belt roller 104 and inner support roller 140 at a speed of 2 feet per second. In constrast, the printing blanket 18 may be driven at a speed of 4 feet per second. At the point in time that the printing blanket 18 gradually slows down unitl it reaches a complete standstill, indicated at S, the one-way driving clutches 154 and 166 are operational to drive the discharge conveyor belt 118 at 2 feet per second. At such time as required the discharge conveyor belt 118 is brought to a complete standstill, as indicated at S-1, in order to permit a transfer from the discharge conveyor belt 118 of a work piece 12. Accordingly the discharge or doffer conveyor belt may be operated at different rates of speed during select intervals of time.

Figure 7:
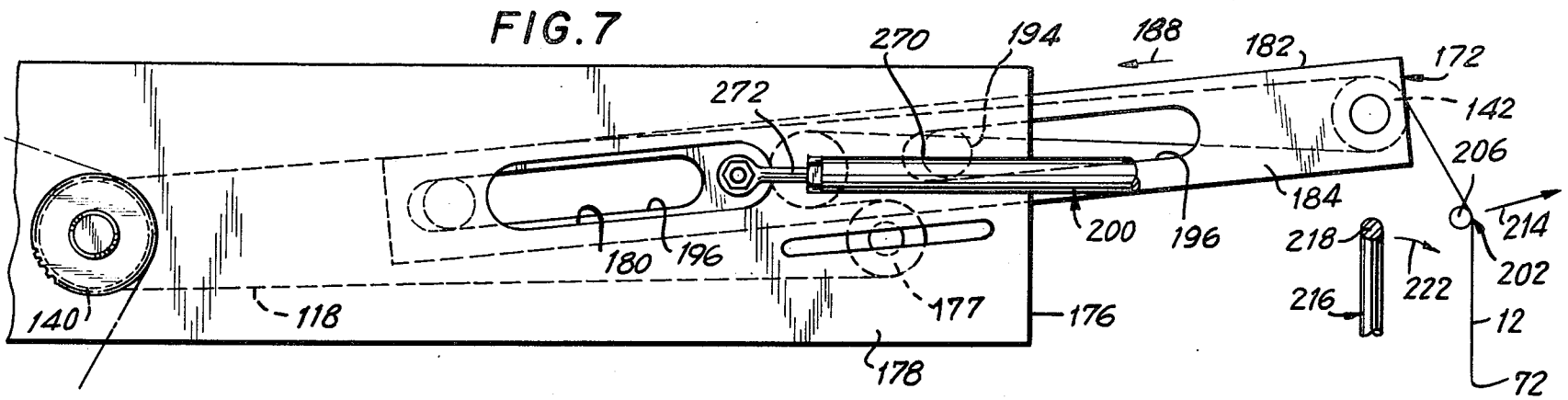
FIG. 7 is a sectional view taken on the line 7—7 of FIG. 6.
Figure 8:
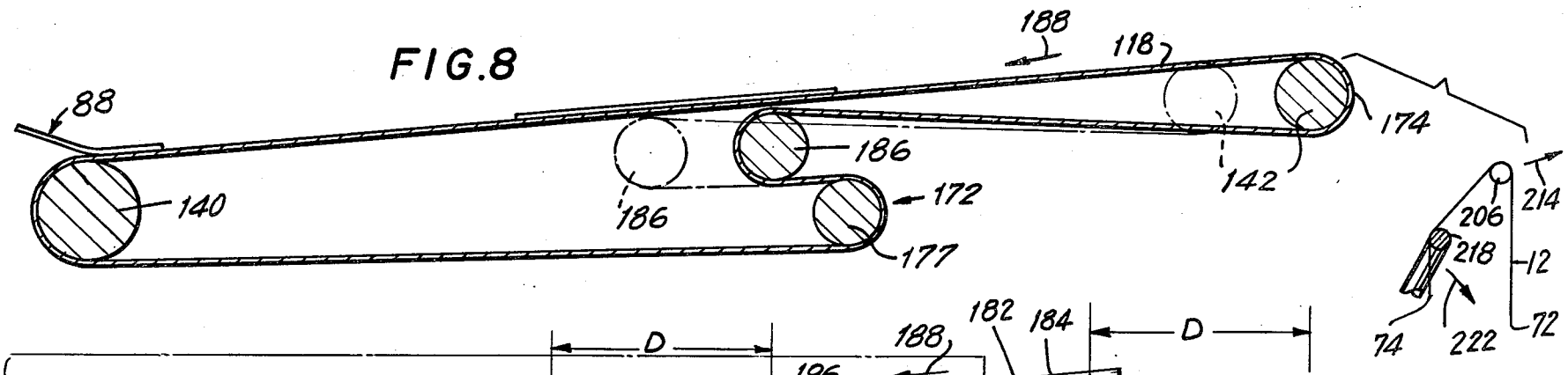
FIG. 8 is a sectional view taken on the line 8—8 of FIG. 6.
Figure 9:
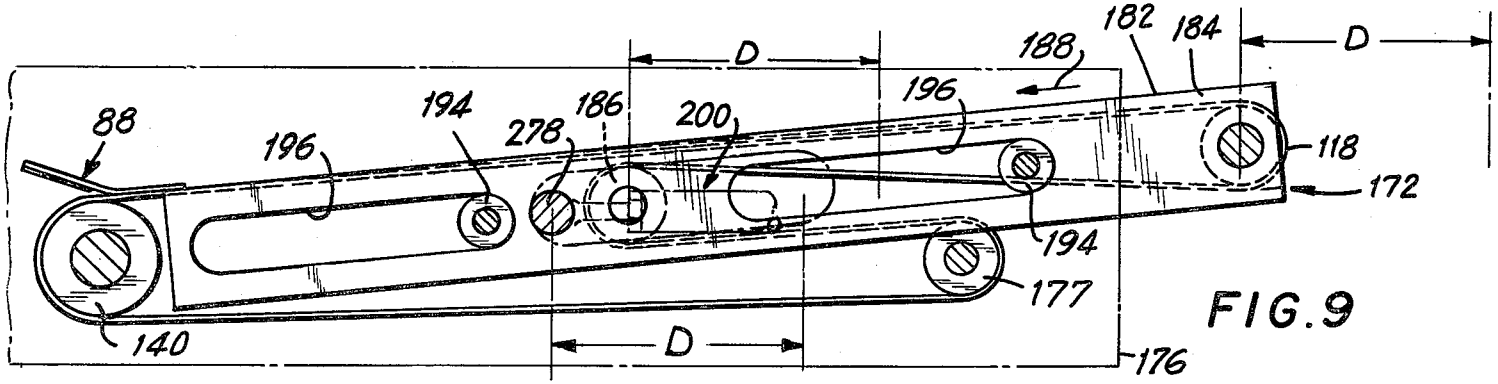
FIG. 9 is a view similar to FIG. 7 illustrating the sequence of movement of the discharge means forming part of the transfer means.

The present invention further provides for the transporting of each individual work piece 12 to drying apparatus 170 disposed at the far end of the apparatus 10. To make the necessary transfer of the work piece 12 from the discharge means 90, the outer roller 142 is sequenced through a series of movements, as illustrated in FIGS. 7 through 9. To accomplish this movement of outer support roller 142, there is provided reciprocating means 172 operatively associated with the outer support roller 142 for reciprocal movement of said outer support roller 142 in a direction towads and away from the inner support roller 140, such that the outer end 174 of the discharge conveyor belt 118 extending over the outer roller 142 is reciprocated in timed relationship to the movement of the work piece 12 along the discharge conveyor belt 118.

The reciprocating means 172 comprises an outer housing 176 having an idler support roller 177 rotatably mounted thereon for movement of the discharge conveyor belt 118 relative thereto. The outer housing 176 includes a pair of oppositely disposed outer members 178 extending on each side of the discharge conveyor belt 118. Each oppositely disposed outer member 178 is mounted in fixed relationship with respect to the side panels 26. An elongated slot 180 may be provided through each outer member 178.

Figure 6:
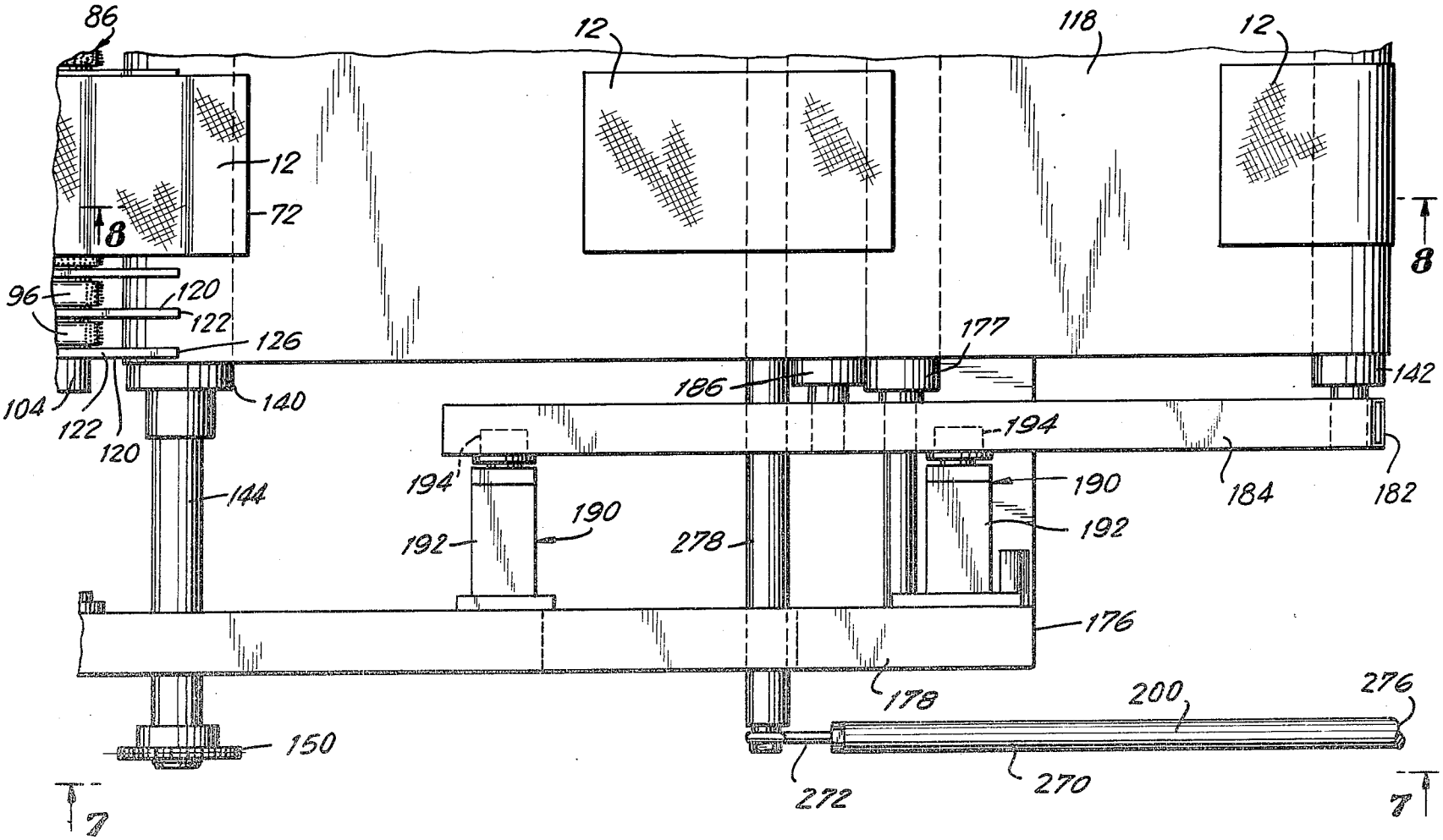
FIG. 6 is a top view of a portion of the transfer means prior to the work piece being transported to the dryer.

An inner housing 182 having the outer support roller 142 rotatably mounted thereon is disposed within the outer frame 176. As illustrated in FIG. 6, there is provided an inner support 184 extending between the discharge conveyor belt 118 and the outer member 178. Each inner support 184 is mounted with respect to the outer member 178 so as to capable of reciprocal motion in order to alter the spacing or distance between the inner support roller 140 and the outer support roller 142.

A take-up support roller 186 is mounted between the inner supports 184 and moves in unison with the outer support roller 142. As illustrated in FIG. 8, movement of the discharge conveyor belt 118 in the direction of arrow 188 is accomplished by moving of inner frame or housing 182 relative to the outer housing 176. Mounting means 190 to permit reciprocation of the inner housing 182 relative to the outer housing 176 so as to vary the spacing between the inner and outer support rollers 140 and 142, respectively, is provided. In this manner the length of the supporting surface of the discharge conveyor belt 118 may be varied in relationship to the position of the work piece 12 thereon.

The mounting means 190 includes mounting blocks 192 coupled to the outer members 178. Each mounting block 192 is provided with a guide pin or roller 194 adapted to be received within corresponding elongated grooves 196 provided in each of the inner supports 184. In this manner reciprocal motion of the inner housing 182 relative to the outer housing 176 may readily occur. Accordingly the guide pins 194 act as bearing means for rolling engagement with the grooves 196.

Figure 10:
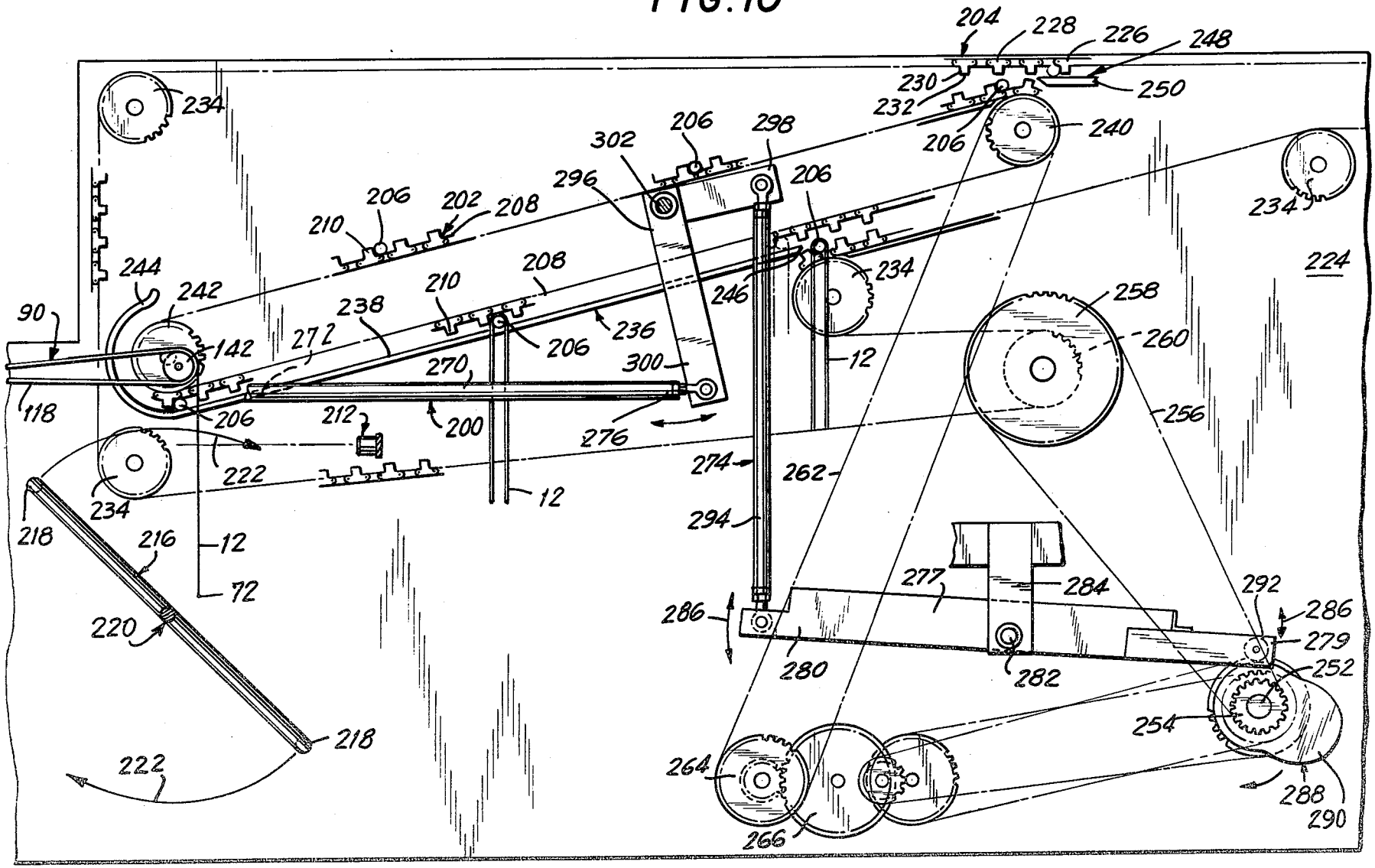
FIG. 10 is a side view of the next section of the printing system for transporting the work piece to the dryer.

To obtain the desired reciprocation of the inner housing 182, there is provided actuating means 200 operatively connected to the inner housing 182. The actuating means 200 is driven in a manner as hereinafter described with respect to the discussion of the transporting means 202 illustrated in FIG. 10. The transporting means 202 is interposed between the discharge means 90 and dryer conveyor means 204. The transporting means 202 includes a series of carrier bars or poles 206 disposed at spaced intervals. As illustrated in FIG. 10, the carrier bars 206 are moved in a closed path by conveyor chains 208 having spaced apart links 210 between which the carrier bar 206 is seated.

The movement of the carrier bars 206 is in timed relationship to the positionment of a work piece 12 with respect to the extension thereof beyond the outer end 174 of the discharge conveyor belt 118. Control means 212, as illustrated in FIG. 10, may comprise an electric eye which senses when the front or forward end 72 of a work piece 12 extends a predetermined distance beyond the outer support roller 142.

Accordingly, whenever the material or work piece 12 is being indexed by the screen printing blanket 18, the removing means 86 driving in unison therewith causes a work piece 12 to be removed from the printing blanket 18 and conveyed to a position wherein a portion of the work piece 12 overhangs the discharge conveyor belt 118. In this position a carrier bar 206 may be moved in the direction of arrow 214 (FIGS. 7 and 8).

The operation of the apparatus 10 is such that the carrier bar 206 is brought into position behind and below the outer support roller 142 prior to the next succeeding work piece being brought into the position illustrated in FIG. 10. The retraction of the discharge conveyor belt 118 is provided, in accordance with one embodiment of the present invention, to permit the carrier bar to be positioned as illustrated in FIG. 10. Therefore, the sequencing of the discharge conveyor belt 118 to the position illustrated in FIG. 9, which is over a dimension D, is sufficient to permit the carrier bar 206 to be brought into the location illustrated in FIG. 10.

Once the carrier bar 206 is so positioned, it is ready to remove the next succeeding work piece 12 that reaches the position in FIG. 10. The control means 212 functions to stop the movement of the discharge conveyor belt 118, as illustrated in FIG. 14 at S-1. At this moment of time the carrier bar 206 may be moved forwardly in the direction of arrow 214. This movement is sufficient to cause the work piece 12 to be draped over the carrier bar 206 and in turn transported to be dried.

It is appreciated that the work piece 12, at this point of time, is still wet with ink thereon and that it has been found desirable to provide supporting means 216 to aid in the transfer between the discharge means 90 and the transporting means 202. Supporting means 216 includes at least one supporting bar 218, two being illustrated, that are mounted to extend transversely and below the discharge conveyor means 118. Positioning means 220 is provided in conjunction with the supporting means 216.

The purpose of the supporting means 216 is to prevent any backlash of the lower portion of the work piece 12 after it is engaged by the carrier bar 206. As illustrated in FIG. 7, the carrier bar 206 engages a work piece 12 and continues movement in the direction of arrow 214. At this, time the supporting bar 218 is moving in the direction of arrow 222 and swings to a position to receive thereon the rearward portion of the work piece 12, as illustrated in FIG. 8. Supporting bar 218 continues in its movement in the direction of arrow 222 such that it moves away from work piece 12, as the work piece is conveyed by the transporting means 202. The positioning means 220 is rotated in a manner (not shown) but in timed relationship to the movement of the individual carrier bar 206 engaging the rear of a work piece 12 for removing same from the discharge conveyor belt 118. In this manner the support bar 218 prevents rearward displacement of the work piece 12 as it is transported onto the carrier bar 206. The supporting means 216 may be rotatably mounted in timed relationship to the movement of the transporting means 202.

The apparatus 10 includes a drying tunnel 224 with the dryer conveyor means 204 having a portion of its endless path traversing through the drying tunnel 224 for drying the work pieces supported on the carrier bars 206. The conveyor means 204 may include a pair of spaced apart conveyor members 226 which may be in the form of endless chains comprised of chain links 228. Each chain link 228 having a lip or rib 230 terminating at an upper or terminal end 232. The supporting bar 218 prevents the tail end 74 of the work piece 12 from engaging the forward end 72 and possibly transfering wet ink thereon. The supporting bar 218 is only momentarily positioned between the overlapping sections of the work piece 12 and slows the fall of the tail end 74, and prevents rearward displacement towards the forward end 72.

The conveyor members 226 are mounted to follow a defined path controlled by the spaced apart rotatably mounted sprockets 234. The defined path of the dryer conveyor means 204 is such that the individual carrier bars 206 are initially transferred from the dryer conveyor means 204 to the transporting means 202 and thereafter with the work piece 12 thereon redeposited or transferred to the dryer conveyor means 204. Thereafter the carrier bars 206 are processed through a drying tunnel 224.

To obtain the continuous transfer, there is provided first changing means 236 for transferring the carrier bars 206 from the transporting means 202 to the spaced apart conveyor members 226 of the dryer conveyor means 204 with a work piece 12 thereon. As illustrated in FIG. 10, the first changing means 236 may include an inclined support 238 in conforming relation with conveyor chains 208 mounted between sprockets 240 and 242. The inclined support 238 has a curved front end 244 and extends below the transporting means 202 until it terminates at 246. The carrier bar 206 moves along the inclined support 238 as it is nested between adjacent links 210.

At the terminal portion 246 the dryer conveyor members 226 extend below the inclined support 238 so as to receive the carrier bar 206, with the work piece thereon, for travel through the drying tunnel 224. Second changing means 248 is disposed at one end of the transporting means 202, adjacent to sprocket 240. The second changing means 248 transfers an empty carrier bar 206 from the second support 250 onto the transporting chain 208 and between adjacent links 210.

To provide for the sequenced movement of the dryer conveyor means 204, transporting means 202 and actuating means 200, there is provided a single drive source identified by drive shaft 252. Drive shaft 252 has a drive sprocket 254 mounted thereon and by means of drive chain 256 drives sprocket 258. Drive sprocket 258 is coupled to sprocket 260 which has the drive chain 226 coupled thereto. This provides the necessary powering of the dryer conveyor means 204.

The transporting means 202 is driven by a drive chain or belt 262 that extends between sprocket 240 and sprocket 264. A chain and gear arrangement 266 extends between sprocket 264 and the drive shaft 252 for driving the transporting means 202 at desired speeds.

As seen in FIG. 10, the actuating means 200 is also driven from the same drive source (shaft 252) and comprises at least one drive arm 270 pivotally connected to the inner housing 182 at the inner end 272 thereof (FIG. 6). The actuating means 200 includes linkage means 274 and third link member 296 which are connected to the other end 276 of the drive arm 270. The linkage means 274 is cam actuated in timed relationship to the movement of the carrier bars 206 by the transporting means 202.

The front end 272 of each drive arm 270 may be coupled to the inner housing 182 by means of a cross member 278 that extends through the inner supports 184 in a pivotally mounted manner. This provides the necessary coupling relationship to transmit the force applied by the drive arms 270. The dryer conveyor means 204 is generally run continuously and the transporting means 202 intermittently.

The linkage means 274 operates from the drive shaft 252 and includes a first link member 277 pivotally mounted intermediate the respective spaced apart ends 279 and 280. A transversely extending pivot pin 282 suspends the first link member 277 from the support arm 284 such that a rocking motion in the direction of double headed arrows 286 may occur at the respective ends 279 and 280. The rocking motion as indicated by arrows 286 is obtained by providing cam means 288 in the form of a cam 290 which is rotated with the drive shaft 252. Cam follower 292 is mounted on one end 279 of first link member 277 and follows the surface of cam 290 for raising and lowering the opposite end 280 of the first link member 277.

A second link member 294 is pivotally coupled at the end 280 to the first link member 277. A third link member 296 is pivotally mounted intermediate the spaced apart ends 298 and 300 thereof. End 298 is coupled to second link member 294 in a pivotal manner. The other end 300 of third link member 296 is pivotally coupled to one end 276 of drive arm 270. A pivot pin 302 pivotally supports the third link member intermediate its ends 298 and 300.

In the manner described above, and as illustrated in FIG. 10, the displacement of the cam follower 292 is translated into a reciprocating motion of the inner housing 182 so as to provide dimensional changes in the length of the discharge conveyor belt 118 in desired timed sequence, or sequentially between an extended position as illustrated in FIG. 7 to a retracted position, as illustrated in FIG. 9. The spacing between the carrier bars 206 is greater on the transporting means 202 then when on the dryer conveyor means 204.

Accordingly, the transporting means 202 is moved in a synchronized manner with respect to the discharge conveyor means 90. In the retracted position of the discharge conveyor belt 118, the next succeeding carrier bar 206 is brought into position for removal of the next individual or grouping of work pieces 12. Upon the transfer of the carrier bar 206 with a work piece 12 thereon to the dryer conveyor means 204, the work piece 12 is then dried in the drying tunnel 224.

Figure 11:
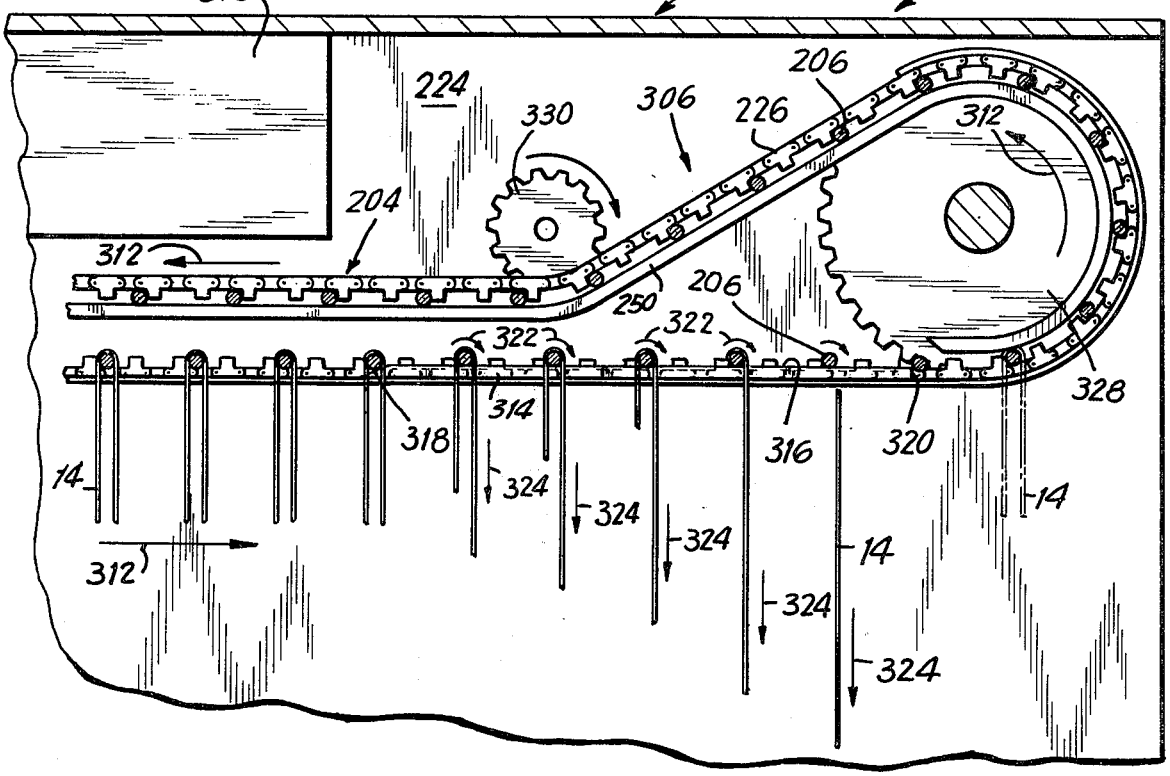
FIG. 11 is an enlarged fragmentary view illustrating the apparatus for releasing of the work piece from the dryer conveyor at the end of the drying operation.
Figure 12:
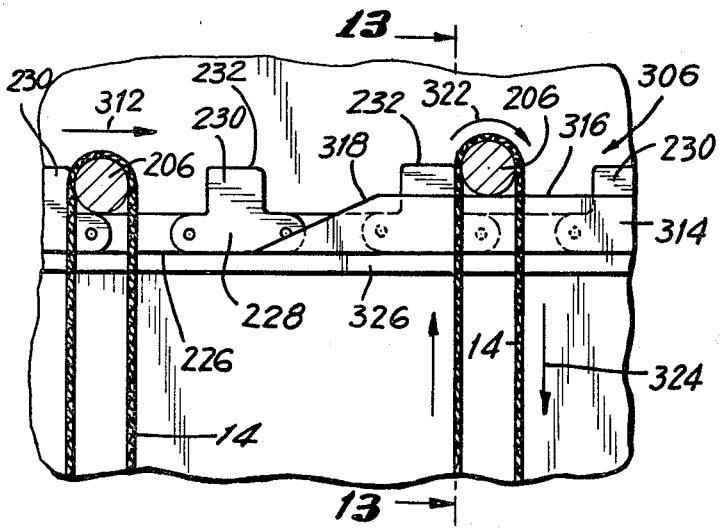
FIG. 12 is an enlarged fragmentary view further illustrating the apparatus for releasing the work piece from a support carrier.
Figure 13:
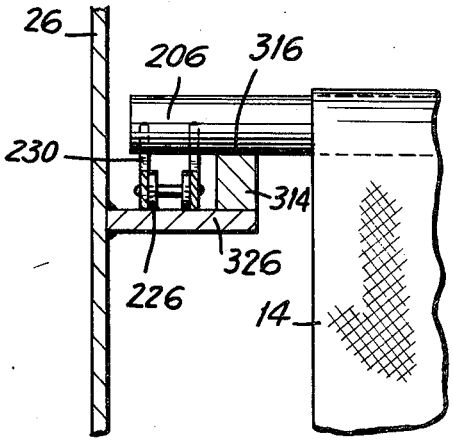
FIG. 13 is a sectional view taken on the line 13—13 of FIG. 12.

An additional feature of the present invention is the provision of releasing means 306, as illustrated in FIGS. 11 through 13, and operatively associated with the dryer conveyor means 204. The purpose of the releasing means 306 is to cause the individual work pieces 12 to be automatically released from positionment on the carrier bars 206 such that the completed work pieces 14 are automatically deposited at a receiving station 308, illustrated in FIG. 1. The receiving station may be in the form of a collecting bin into which the completed work pieces 14 automatically fall when released from their respective carrier bars 206. Carrier bars 206 are continuously recycled through the apparatus 10 for reuse. The spacing between the carrier bars 206 are closer together on the dryer conveyor means 204 such that there is a maximum utilization of space.

As illustrated in FIG. 11, a heater 310, of a type well known in the art, is contained within the drying tunnel 224 and forms part of the drying apparatus 170. The endless conveyor members 226 move in the direction of arrows 312 over their endless path.

The releasing means includes a releasing rail 314 associated with each one of the conveyor members 226, as illustrated in FIG. 11. The rails 314 are mounted in laterally fixed spaced relationship to each other and have a rail surface 316 for receiving the spaced apart carrier bars 206 thereon, as the conveyor members 226 move relative to the rails 314.

Each rail 314 has a front end 318 and a spaced apart rear end 320. The front end 318 is contoured, to gradually raise each carrier bar 206 onto the rail surface 316 as the conveyor members 226 are moved progressively along in the direction of arrows 312. The contoured front end 318 may be in the form of an inclined surface. When the carrier bar 206 reaches the rail surface 316, it is free for rolling engagement along the length of each rail surface 316. As this rolling engagement occurs, as indicated by arrows 322, there is a lowering of the completed work piece 14 in the direction of the individual arrows 324. This continues until the weight of the finished work piece 14 is such as to permit gravity to free the completed work piece 14 from its respective carrier bar 206.

Prior to being raised onto the surface 316 of rails 314, carrier bar 206 extends between respective chain links 228 and in abutting engagement to a lip 230. In this relationship there is no rolling engagement of the carrier bar 206 relative to the conveyor members 226.

As illustrated in FIG. 13, each rail 314 may be mounted on a platform 326 over which the conveyor member 226 travels. The platform extends inwardly from side panel 26.

The conveyor members reverse their direction at one end of the assembly 10 and as such the second support 250 is utilized to maintain the carrier bars 206 in position until they are transferred to the transporting means 202, as illustrated in FIG. 10. Additional drive sprockets 328 and 330 may be provided in a manner well known in the art.

If the work piece 14, which has now been dried, is to be released, the rail surfaces 316 are longitudinally dimensioned between the front end 318 and the rear end 320 so as to obtain sufficient rolling engagement of each carrier bar 206 for the work piece 14 to be released therefrom prior to the support bar reaching the rear end 320. The rail surfaces 316 may extend in substantially a horizontal plane transversely to the path of travel of the conveyor members 226.

If the releasing means of the present invention were not utilized, then the work piece 14 would reach the position illustrated in phantom in FIG. 11 and thereafter manually removed from the support carrier 206. The present invention permits an in line continuous printing system in which the only manual labor required is the initial positionment of the work pieces on the printing blanket 18. Thereafter, the work piece is sequenced through a series of operations until they are automatically deposited in the collecting bin 308.

Figure 15:
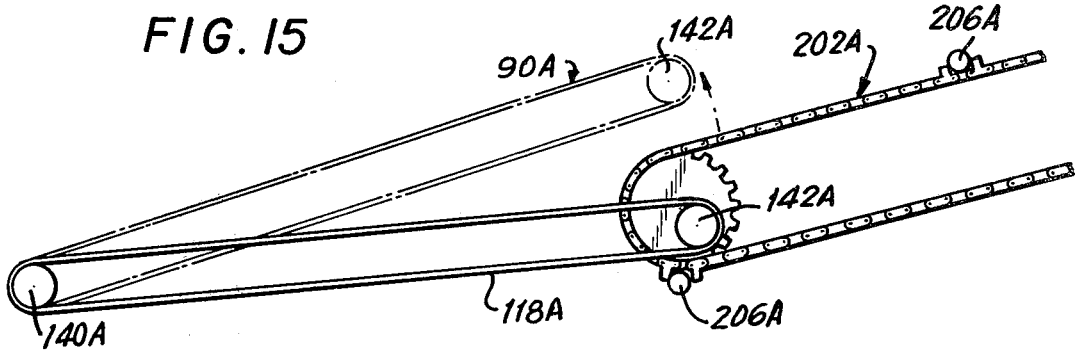
FIGS. 15–18 are diagrammatic views illustrating alternate embodiments of the present invention for transferring the work piece to a carrier bar for transporting through the dryer.

Referring now to FIG. 15, there is depicted another embodiment of discharge means 90A formulated in accordance with the principles of the present invention, wherein similar parts are illustrated by similar reference numerals. As previously illustrated with respect to FIGS. 7 through 9, the discharge conveyor belt 118A is expanded and contracted between the respective end rollers. In the embodiment of FIG. 15, the distance between the inner support roller 140A and outer support roller 142A remains fixed. In order to permit the carrier bars 206A to be brought into position for removal of a work piece from the discharge conveyor belt 118A, the discharge conveyor belt is alternately raised and lowered.

The transporting means 202A would operate in the same manner as previously discussed except that the discharge conveyor belt 118A is pivoted with respect to inner support roller 140A between the position illustrated in solid lines and that illustrated in phantom lines. In the raised position, as illustrated by the phantom lines, the next succeeding carrier bar is brought around to be ready to receive thereon the next work piece. The raising and lowering of the discharge means 90A may be accomplished by means well known in the art.

Figure 16:
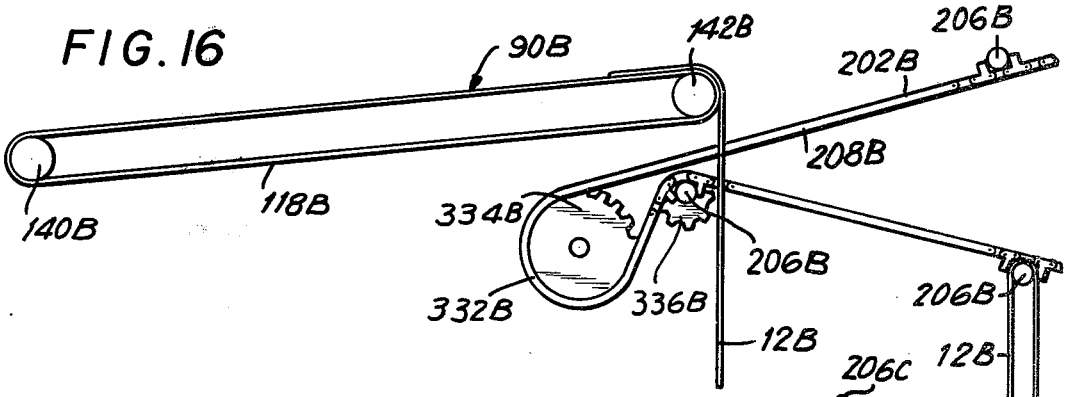

Referring now to FIG. 16, there is depicted another embodiment for the combustion of the discharge means 90B and transporting means 202B. In this embodiment the discharge conveyor belt 118B remains in fixed position with respect to the inner support roller 140B and the outer support roller 142B. There is no movement of rollers 140B or 142B as in the embodiment illustrated in FIG. 15. To bring the carrier bar 206B into position behind the work piece 12B, an additional loop 332B is provided such that the conveyor chains 208B follow a path below outer support roller 142B around sprocket 334B and then upwardly over sprocket 336B so as to position carrier bar 206B in place. The transporting conveyor means 202B is then stopped until the work piece 12B substantially reaches the position illustrated in FIG. 16 prior to moving forward with the result that the work piece 12B becomes draped over the carrier bar 206B.

Figure 17:
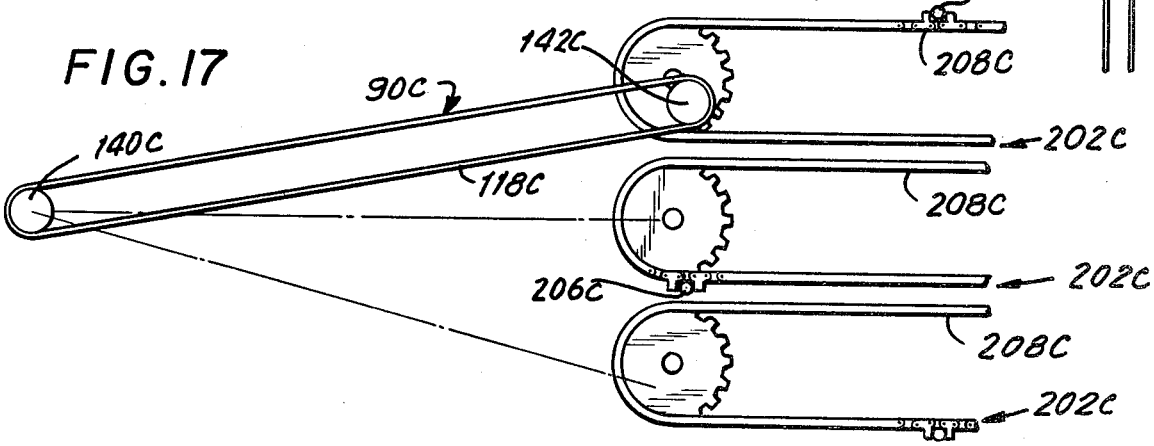

FIG. 17 is now referred to and depicts another embodiment of the present invention for transferring a work piece from discharge means 90C to transporting means 202C. In this embodiment, the discharge conveyor belt 118C mounted with respect to inner support roller 140C and outer support roller 142C is raised and lowered into different positions, conjointly with reciprocating movement of the discharge means 90C, three being illustrated. In each of the positions there is provided a separate conveyor chain 208C which sequentially brings carrier bars 206C into position. In this manner the carrier bars 206C may thereafter be transferred to the same or different drying apparatus as desired.

Figure 18:
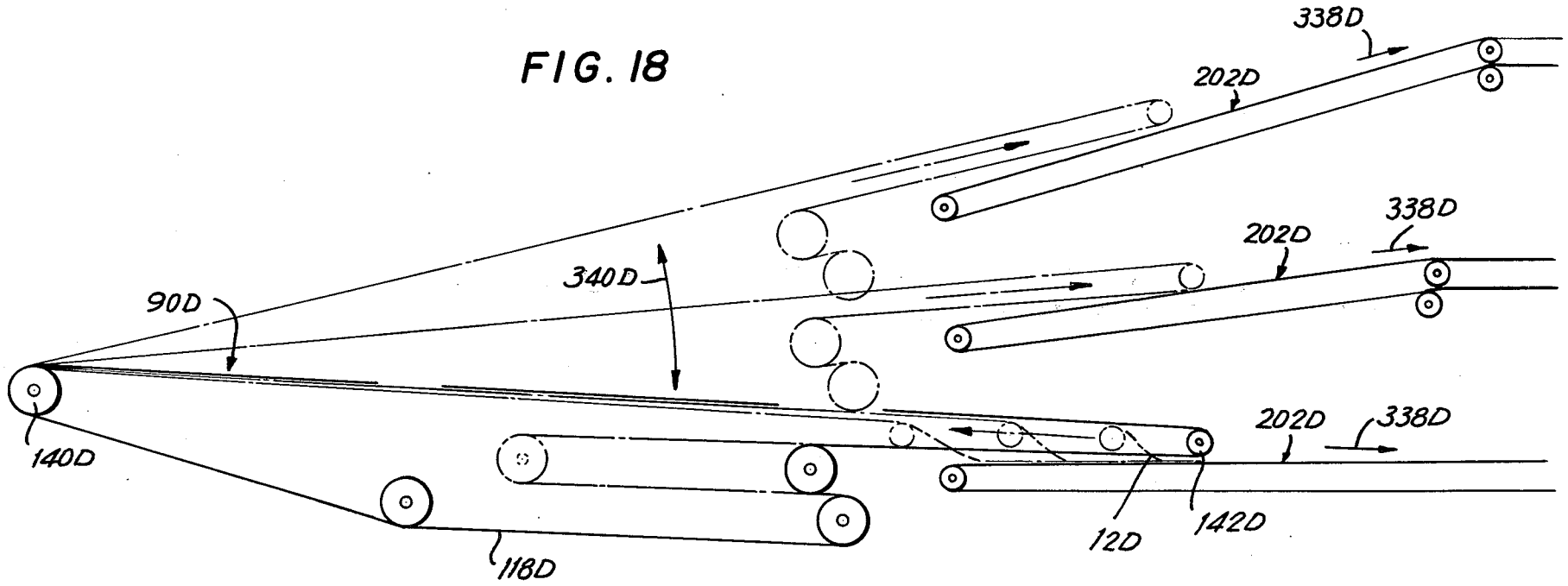

Referring now to FIG. 18, there is illustrated another embodiment, wherein similar parts are illustrated by similar reference numerals. The embodiment of FIG. 18 combines certain features of the embodiment illustrated in FIGS. 7 through 9 and that illustrated in FIG. 17. The discharge means 90D is such that the distance between outer support roller 142D and inner support roller 140D may be varied in order to discharge the work piece onto one or more transporting means 202D.

The transporting means 202D may be in the form of endless conveyor belts that are moving in the direction 338D such that the work piece 12D is deposited thereon due to the synchronized movement of the discharge conveyor means 90D moving between extended and retracted positions. Furthermore, the movement of the discharge conveyor belt 118D is also in the direction of the double headed arrow 340D. This movement by being properly timed permits the depositing of the work piece on the transporting means 202D.

Figure 19:
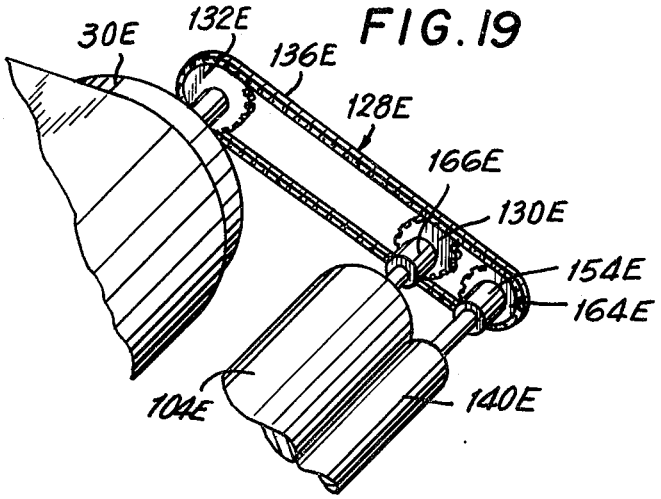
FIG. 19 is a perspective view illustrating a modified driving arrangement between the printing blanket drive and the transfer drive.
Figure 4:
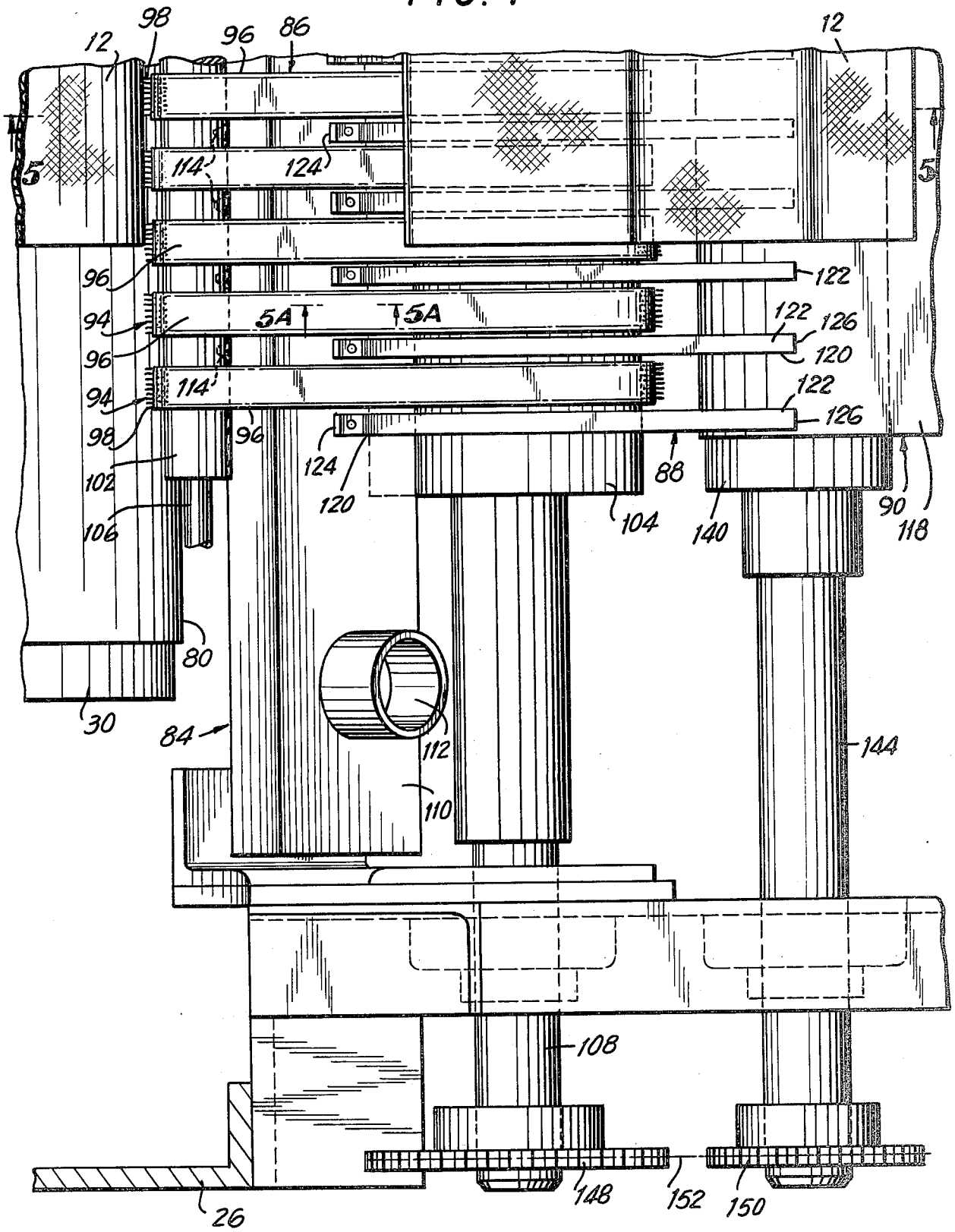
FIG. 4 is a top plan view illustrating the transfer means between the printing blanket and the discharge means.

A final embodiment of the invention is illustrated in FIG. 19 in which the first drive means 128E is such that the drive chain 136E is connected to sprocket 132E, 130E and 164E. In this manner the rollers 30E, 104E and 140E may be driven together and the one-way clutches 154E and 166E utilized in the manner previously described.

The selective movement of each piece through the various sections of the apparatus or system is obtained in a sequenced or timed relationship by the utilization of timing and other means well known in the art. The speed at which the work piece travels through the apparatus can be adjusted dependent upon the size and shape of the work piece, as well as other known considerations. The changes required can be obtained by varying certain of the electrical controls associated with the apparatus which are of a type and design well known in the art.

It will be apparent to those skilled in the art that the present invention permits the loading of a printing machine by either a single individual or a plurality of individuals and obviates the necessity of having more than one person required at the discharge or take-off end of the apparatus. Moreover, the utilization of the apparatus to print the work pieces three abreast further improves the state of the art. The foregoing features result in greater production capacity at reduced labor costs.

It will also be apparent that various ways of securing the work piece to the printing blanket fall within the scope of the present invention. Although an adhesive has been suggested, suction or other means may be utilized. For example, the weight of the work piece may be sufficient to have it remain fixed in place. To peelingly strip the work piece from the printing blanket is an aspect of the invention whether or not an adhesive is used to secure the work piece to the printing blanket, or a suction force is applied.

While I have shown and described the various preferred embodiments of the present invention, it will be appreciated that the teachings herein will readily lend itself to many modifications, changes, combinations and improvements by those skilled in the art, without deviation from the present invention or the teachings hereof.

What is claimed is:

1. Apparatus for use in combination with a screen printing machine having an endless movable printing blanket and a discharge end, said endless movable printing blanket being capable of having a work piece to be screen printed adhered thereon, said apparatus comprising transfer means disposed adjacent to the discharge end of a screen printing machine for effecting the movement of said work piece from a printing blanket to said transfer means, removing means including a series of spaced apart endless belt strips, said transfer means comprising elevating means for initially lifting the leading edge of said work piece upwardly from said printing blanket so as to suspend the leading edge until the work piece is advanced a predetermined distance for subsequent engagement by said removing means such that the leading edge bridges any spacing between the discharge end of said screen printing machine and said transfer means, said removing means being disposed in predetermined operating relationship with respect to said elevating means, gripping means comprising a plurality of needle like elements formed on the surface of said series of spaced apart endless belt strips for gripping the work piece and peelingly stripping said adhered work piece from said printing blanket to effect the transfer of the work piece from said printing blanket to said series of endless belt strips, said gripping means first engaging the leading edge suspended by said elevating means, and first drive means for driving said endless belt strips in timed relationship to said printing blanket such that during the relative movement therebetween said elevating means lifts the leading edge of the work piece and causes said gripping means to peelingly strip the work piece from said printing blanket.

2. Apparatus in accordance with claim 1, wherein said elevating means comprises fluid means extending below said gripping means and directing a flow of fluid interproximal of the leading edge of the work piece and said discharge end of said screen printing machine.

3. Apparatus in accordance with claim 2, wherein said elevating means includes a conduit extending transversely to the direction of travel of the work piece, and a plurality of spaced apart ports operatively associated with said conduit for directing the flow of fluid in the direction of said discharge end upon which the work piece is traversing.

4. Apparatus in accordance with claim 3, wherein said ports are positioned to provide a flow of fluid intermediate said series of spaced apart endless belt strips.

5. Apparatus in accordance with claim 1, wherein said plurality of needle like elements are disposed in a substantially vertical plane having pointed tips to define a gripping surface so as to engage and cause a pulling force to be transmitted to the work piece in the direction of travel of said printing blanket.

6. Apparatus in accordance with claim 5, wherein said needle like elements are inclined at an acute angle relative to the direction of travel of said endless belt strips.

7. Apparatus in accordance with claim 6, wherein said acute angle is approximately 75 degrees.

8. Apparatus in accordance with claim 1, wherein said endless belt strips are substantially equidistantly spaced from one another.

9. Apparatus in accordance with claim 1, wherein said transfer means further comprises a frame disposed adjacent said discharge end of said printing blanket, a pair of end rollers rotatably journalled on said frame in spaced apart relationship, said endless belt strips being threaded over said end rollers, said first drive means being interconnected between said printing blanket and one of said end rollers such that said removing means is driven in unison with said printing blanket, second drive means connected in driving relationship to said one of said end rollers to effect the drive of said removing means independently of said first drive means, and said first drive means being capable of overdriving said second drive means.

10. Apparatus in accordance with claim 1, wherein said transfer means further comprises discharge means disposed adjacent said belt strips for receiving the work piece therefrom, stripper means interposed in the spaces between said belt strips to separate and facilitate the transfer of the work piece from said belt strips to said discharge means, said first drive means including means for driving said endless belt strips substantially in unison with said printing blanket, and means for effecting the drive of said discharge means in response to the drive of said endless belt strips.

11. Apparatus in accordance with claim 10, wherein said stripper means includes a plurality of elongated plates, respective ones of said elongated plates being disposed in said spaces between said belt strips, each of said plates having an upper surface, and said plates being angularly disposed relative to said belt strips so as to support the work piece thereon as said belt strips move below said upper surface of each of said plates.

12. Apparatus in accordance with claim 10, including transporting means extending adjacent one end of said discharge means, said transporting means including at least two transport conveyors disposed in substantially overlapping spaced apart relationship to each other and capable of receiving the work piece thereon and subsequent transport thereof for drying, said discharge means comprising an endless flexible discharge conveyor belt extending between a pair of oppositely disposed inner and outer support rollers, said inner and outer support rollers being disposed in spaced apart relationship to each other and said inner support roller being mounted in spacially fixed relationship with respect to said removing means, reciprocating means operatively associated with said outer support roller for reciprocal movement of said outer support roller in a direction towards and away from said inner support roller such that the outer end of said discharge conveyor belt which extends over said outer roller is reciprocated in timed relationship to the movement of the work piece along said discharge conveyor belt, and means for raising and lowering of said outer support roller in a direction towards and away from said transport conveyors such that the outer end of said discharge conveyor belt which extends over said outer roller is raised and lowered in timed relationship to sequentially deposit work pieces on each of said transport conveyors.

13. Apparatus in accordance with claim 10, wherein said first drive means effects intermittent movement of said printing blanket, said endless belts being connected in driving relationship with said first drive means, dryer conveyor means disposed adjacent one end of said discharge means for receiving the work piece, and said dryer conveyor means including a pair of spaced apart conveyor members traversing an endless path.

14. Apparatus in accordance with claim 13, including transporting means interposed between said discharge means and said dryer conveyor means, said transporting means including a series of carrier bars disposed at spaced intervals, control means for effecting the intermittent drive of said carrier bars, and said control means effecting the intermittent drive of said transporting means when the work piece is disposed on said discharge means in a position to be readily removed therefrom by one of said carrier bars.

15. Apparatus in accordance with claim 14, wherein said discharge means comprises an endless flexible discharge conveyor belt, a pair of oppositely disposed inner and outer support rollers disposed in spaced relationship with respect to one another, said discharge conveyor belt extending between said pair of support rollers, said inner support roller being mounted in spacially fixed relationship with respect to said removing means, and reciprocating means operatively associated with said outer support roller for reciprocal movement of said outer support roller in a direction towards and away from said inner support roller such that the outer end of said discharge conveyor belt which extends over said outer roller is reciprocated in timed relationship to the movement of the work piece along said discharge conveyor belt.

16. Apparatus in accordance with claim 15, wherein said reciprocating means comprises an outer housing having an idler support roller rotatably mounted thereon for movement of said discharge conveyor belt relative thereto, an inner housing having said outer support roller rotatably mounted thereon, a take-up support roller rotatably mounted on said inner housing for movement of said discharge conveyor belt relative thereto, mounting means to permit reciprocation of said inner housing relative to said outer housing so as to vary the spacing between said inner and outer support rollers for varying the length of the supporting surface of said discharge conveyor belt in relationship to the position of the work piece thereon, and actuating means operatively connected to said inner housing for causing reciprocation thereof relative to said inner support roller and said outer housing.

17. Apparatus in accordance with claim 14, wherein said discharge means comprises an endless flexible discharge conveyor belt extending between a pair of support rollers which are mounted in fixed spaced relationship with respect to one another, and said transporting means positioning said carrier bar below said discharge conveyor belt in timed relationship to the movement of the work piece along said discharge conveyor belt.

18. Apparatus in accordance with claim 14, including first changing means for transferring said carrier bars having a work piece thereon from said transporting means to said spaced apart conveyor members of said dryer conveyor means, and second changing means for transferring said carrier bars from said spaced apart conveyor members of said dryer conveyor means to said transporting means subsequent to the removal of the work piece therefrom.

19. Apparatus in accordance with claim 14, wherein said discharge means comprises an endless flexible discharge conveyor belt extending between a pair of oppositely disposed inner and outer support rollers which are disposed in spaced relationship with respect to one another with said inner support roller being mounted in spacially fixed relationship with respect to said removing means, and means for raising and lowering of said outer support roller in a direction towards and away from said transporting means to cause the outer end of said discharge conveyor belt which extends over said outer roller to be raised and lowered in timed relationship to the movement of said carrier bar, thereby enabling said carrier bar to be in a position to receive the work piece moving along said discharge conveyor belt.

20. Apparatus in accordance with claim 19, wherein said transporting means includes at least two sections disposed at different elevational levels, said transporting means being capable of feeding carrier bars into predetermined positions, and said raising and lowering means being capable of sequenced operation to cause said discharge conveyor belt to be pivoted into preselected positional relationship with respect to each of said sections.

21. Apparatus in accordance with claim 16, including a drying tunnel, and said dryer conveyor means having a segment of the endless path conveyor members thereof transversing through said drying tunnel for drying the work piece supported on said carrier bars.

22. Apparatus in accordance with claim 21, wherein said mounting means comprises a pair of grooves formed in said outer housing, respective ones of said grooves being adjacently disposed between the spaced apart respective sides of said inner housing, and bearing means extending outwardly from each side of said inner housing for rolling engagement within said grooves, to thereby effectuate reciprocation of said inner housing relative to said outer housing.

23. Apparatus in accordance with claim 21, wherein said actuating means comprises at least one drive arm pivotally connected to said inner housing at one end thereof, linkage means connected to said drive arm on the opposite end thereof, and said linkage means being cam actuated in timed relationship to the movement of said carrier bars by said transporting means.

24. Apparatus in accordance with claim 23, wherein said linkage means comprises a first link member pivotally mounted intermediate the spaced apart ends thereof with respect to said cam, a cam follower mounted on one end of said first link member for raising and lowering the opposite end of said first link member, a second link member having one end thereof pivotally connected to said opposite end of said first link member, a third link member pivotally mounted intermediate the spaced apart ends thereof between said first link member and said second link member, one end of said third link member being pivotally connected to one end of said second link member, and the opposite end of said third link member being pivotally connected to the opposite end of said drive arm, whereby displacement of said cam follower is translated into reciprocating motion of said inner housing by said drive arm to provide dimensional variation of the effective length of said discharge conveyor belt in desired timed sequence.

25. Apparatus in accordance with claim 23, including supporting means operatively mounted relative to said discharge means, said supporting means including at least one support bar extending transversely across and below said discharge conveyor means, means for positioning said support bar behind the work piece in timed relationship with the engagement of one of said carrier bars with the rear of a work piece for removal thereof from said discharge conveyor belt, and said support bar engaging the rear of the work piece below said one of said carrier bars to prevent rearward displacement of the work piece as it is transported onto said carrier bar.

26. Apparatus in accordance with claim 25, wherein said supporting means is rotatably mounted and includes a pair of oppositely disposed support bars.

27. Apparatus in accordance with claim 13, wherein said pair of spaced apart conveyor members are capable of supporting said carrier bars having a work piece disposed thereon, and releasing means operatively associated with said dryer conveyor means so as to cause the work piece to be automatically released from its position on said carrier bars, such that the completed work piece is received at a receiving station.

28. Apparatus in accordance with claim 27, wherein said releasing means comprises a releasing rail operatively associated with each of said conveyor members, said rails being mounted in laterally fixed spaced relationship with respect to one another, said rails having a rail surface for receiving said spaced apart carrier bars thereon as said conveyor members move relative to said rails, said conveyor members including a support surface, said rails including a front end and a spaced apart rear end, and said front end being contoured for raising said carrier bars above said support surface provided by said conveyor members and onto each said rail surface to provide rolling engagement of each of said carrier bars along said rail surfaces such that one end of the work piece is gradually lowered until it descends from said carrier bar on which said work piece was disposed.

29. Apparatus in accordance with claim 28, wherein said contoured front end is inclined at a predetermined angular orientation to effectuate the gradual elevation of each of said carrier bars onto said rail surfaces as said carrier bars are progressively moved by said conveyor members, said rail surfaces being longitudinally dimensioned between said front and rear ends so as to cause sufficient rolling engagement of each of said carrier bars for releasing the work piece therefrom prior to said support bar reaching said rear end, and said rail surfaces being disposed in substantially a horizontal plane transverse to the path of travel of said conveyor members.

30. Apparatus for conveying an adhesively secured work piece away from an endless and movable printing blanket having a discharge end, comprising transfer means disposed adjacent said discharge end of said movable printing blanket for effecting the movement of the work piece from said printing blanket, said transfer means comprising elevating means for initially lifting the leading edge of the work piece away from said printing blanket so as to suspend the leading edge until the work piece is advanced a predetermined distance and positioned for engagement by said transfer means such that the leading edge bridges any spacing between said discharge end of said printing blanket and said transfer means, removing means including a series of spaced apart endless belt strips operatively associated with said elevating means, gripping means formed on the surface of said series of spaced apart endless belt strips for gripping the work piece and peelingly stripping said adhered work piece from said printing blanket to effect the transfer of the work piece from said printing blanket to said series of endless belt strips, said gripping means first engaging the leading edge suspended by said elevating means, said gripping means comprises a plurality of needle-like elements disposed in a substantially vertical plane having pointed tips to define a gripping surface so as to engage and cause a pulling force to be transmitted to the work piece in the direction of travel of said printing blanket, said elevating means comprising fluid means extending below said gripping means and directing a flow of fluid interproximally of the leading edge of the work piece and said discharge end of said printing blanket, discharge means disposed adjacent said belt strips for receiving the work piece therefrom, stripper means interposed in the spaces between said belt strips to separate and facilitate the transfer of the work piece from said belt strips to said discharge means, said stripper means including a plurality of elongated plates, each of said plates having an upper surface and each of said plates being mounted in one of said spaces between said belt strips, said plates being angularly disposed relative to said belt strips so as to support the work piece thereon as said belt strips move below said upper surface of each of said plates, and first drive means for driving said endless belt strips in timed relationship to said printing blanket such that during the relative movement therebetween said elevating means lifts the leading edge of the work piece and causes said gripping means to peelingly strip the work piece from said printing blanket.

31. Apparatus in accordance with claim 30, wherein said elevating means includes a conduit extending transversely to the direction of travel of the work piece, a plurality of spaced apart ports operatively associated with said conduit for directing the flow of fluid in the direction of said discharge end upon which the work piece is traversing, and said ports being positioned to provide a flow of fluid intermediate said series of spaced apart endless belt strips.

32. Apparatus in accordance with claim 30, wherein said needle like elements are inclined at an acute angle relative to the direction of travel of said endless belt strips, said acute angle is approximately 75 degrees, and said endless belt strips are substantially equidistantly spaced from one another.

33. Apparatus in accordance with claim 30, wherein said first drive means effects intermittent movement of said printing blanket, said endless belts being connected in driving relationship with said first drive means, dryer conveyor means disposed adjacent one end of said discharge means for receiving the work piece, said dryer conveyor means including a pair of spaced apart conveyor members traversing an endless path, said discharge means comprises an endless flexible discharge conveyor belt, a pair of oppositely disposed inner and outer support rollers in spaced apart relationship to one another, said discharge conveyor belt extending between said support rollers, said inner support roller being mounted in spacially fixed relationship with respect to said removing means, and reciprocating means operatively associated with said outer support roller for reciprocal movement of said outer support roller in a direction towards and away from said inner support roller such that the outer end of said discharge conveyor belt which extends between said outer roller is reciprocated in timed relationship to the movement of the work piece along said discharge conveyor belt.

34. Apparatus in accordance with claim 33, wherein said reciprocating means comprises an outer housing having an idler support roller rotatably mounted thereon for movement of said discharge conveyor belt relative thereto, an inner housing having said outer support roller rotatably mounted thereon, a take-up support roller rotatably mounted on said inner housing for movement of said discharge conveyor belt relative thereto, mounting means for permitting reciprocation of said inner housing relative to said outer housing so as to vary the spacing between said inner and outer support rollers for varying the length of the supporting surface of said discharge conveyor belt in relationship to the position of the work piece thereon, and actuating means operatively connected to said inner housing for causing reciprocation thereof relative to said inner support roller and said outer housing.

35. Apparatus in accordance with claim 33, wherein said pair of spaced apart conveyor members are capable of supporting carrier bars with a work piece supported thereon, releasing means operatively associated with said dryer conveyor means so as to cause the work piece to be automatically released from its position on said carrier bars, such that the completed work piece is received at a receiving station, said releasing means comprising a releasing rail operatively associated with each one of said conveyor members, said rails being mounted in laterally fixed spaced relationship with respect to each other and having a rail surface for receiving said spaced apart carrier bars thereon as said conveyor members move relative to said rails, and said rails having a front end and a spaced apart rear end, said front end being contoured for raising said carrier bars above the support surface provided by said conveyor members and onto each said rail surface to cause rolling engagement of each of said carrier bars along said rail surfaces such that one end of the work piece is gradually lowered until it descends from said carrier bar on which said work piece was positioned.

36. Apparatus in accordance with claim 35, wherein said contoured front end is inclined at a predetermined angular orientation to gradually raise each of said carrier bars onto said rail surfaces as said carrier bars are progressively moved by said conveyor members, said rail surfaces are longitudinally dimensioned between said front and rear ends so as to cause sufficient rolling engagement of each of said carrier bars for the work piece to be released therefrom prior to said support bar reaching said rear end, and said rail surfaces extending in a substantially horizontal plane which is transverse to the path of travel of said conveyor members.

37. Apparatus in accordance with claim 33, including transporting means disposed between said discharge means and said dryer conveyor means, said transporting means including a series of carrier bars disposed at spaced intervals, control means for effecting the intermittent drive of said carrier bars, and said control means effecting the intermittent drive of said transporting means when the work piece is disposed on said discharge conveyor belt in a position to be readily removed therefrom by one of said carrier bars.

38. Apparatus in accordance with claim 37, including first changing means for transferring said carrier bars having a work piece thereon from said transporting means to said spaced apart conveyor members of said dryer conveyor means, and second changing means for transferring said carrier bars from said spaced apart conveyor members of said dryer conveyor means to said transporting means subsequent to the removal of the work piece therefrom.

39. Apparatus in accordance with claim 37, including supporting means operatively mounted relative to said discharge means, said supporting means including at least one support bar extending transversely across and below said discharge conveyor means.

means for positioning said support bar behind the work piece in timed relationship with the engagement of one of said carrier bars with the rear of a work piece for removal thereof from said discharge conveyor belt, and said support bar engaging the rear of the work piece below said one of said carrier bars to prevent rearward displacement of the work piece as it is transported onto said carrier bar.

40. Apparatus for printing comprising in combination a screen printing apparatus having an intermittently operated endless printing blanket on which a work piece is adhesively supported and indexed during a screen printing operation, a drying tunnel, dryer conveyor means including a pair of spaced apart conveyor members traversing an endless path, a portion of said endless path extending through said drying tunnel for drying the work piece supportingly disposed on carrier bars, transfer means disposed intermediate the discharge end of said printing blanket and said drying tunnel so as to effect the movement of the work piece from said printing blanket to said dryer conveyor means, said transfer means comprising, removing means including a series of spaced apart endless belt strips operatively associated with said printing blanket at one end of said belt strips, elevating means for initially lifting the leading edge of the work piece away from said printing blanket so as to suspend the leading edge until the work piece is advanced in a position for engagement by said removing means such that the leading edge bridges any spacing between said discharge end of said printing blanket and said removing means, gripping means formed on the surface of said series of spaced apart endless belt strips for gripping the work piece and peelingly stripping the work piece adhered to said printing blanket to effect the transfer of the work piece from said printing blanket to said series of endless belt strips, said elevating means comprising fluid means directing a flow of fluid interproximally of the leading edge of the work piece and said discharge end of said printing blanket, discharge means including an endless flexible discharge conveyor belt mounted between spaced apart inner and outer support rollers, said discharge conveyor belt being disposed adjacent said belt strips at the other end thereof for receiving the work piece from said belt strips, stripper means interposed in the spaces between said belt strips to separate and facilitate the transfer of the work piece from said belt strips to said discharge means, drive means for driving said endless belt strips and said discharge means in timed relationship to and independently of said printing blanket, reciprocating means operatively associated with said outer support roller for reciprocal movement of said outer support roller between extended and retracted positions, towards and away from said inner support roller such that the outer end of said discharge conveyor belt which extends over said outer roller is reciprocated in timed relationship to the movement of the work piece along said discharge conveyor belt, transporting means interposed between said discharge conveyor belt and said dryer conveyor means for movement of said carrier bars thereon, control means for effecting the intermittent drive of said carrier bars when said outer support roller is in its retracted position such that when the work piece is disposed upon said discharge conveyor belt in a proper position it is readily removable therefrom by one of said carrier bars, supporting means operatively mounted relative to said transporting means and including at least one support bar extending transversely across and below said discharge conveyor means so as to engage the rear of a work piece preventing rearward displacement of the work piece as it is transported together with said carrier bar, and changing means for first transferring said carrier bars having a work piece thereon from said transporting means to said spaced apart conveyor members of said dryer conveyor means and secondly transferring said carrier bars from said spaced apart conveyor members of said dryer conveyor means to said transporting means subsequent to the removal of the work piece therefrom.

41. Apparatus in accordance with claim 40, including releasing means operatively associated with said dryer conveyor means to cause automatic release of said work piece from its position on said carrier bars, thereby enabling the completed work piece to be received at a receiving station, said releasing means comprising a releasing rail operatively associated with each of said conveyor members, said rails being mounted in laterally fixed spaced relationship with respect to each other, said rails having a rail surface for receiving said spaced apart carrier bars thereon as said conveyor members move relative to said rails, said rails including a front end and a spaced apart rear end, and said front end being contoured for raising carrier bars above the support surface provided by said conveyor members and onto each said rail surface to cause rolling engagement of each of said carrier bars along said rail surfaces such that one end of the work piece is gradually lowered until it descends from said carrier bar on which said work piece was disposed.

42. Apparatus in accordance with claim 41, wherein said contoured front end is inclined at a predetermined angular orientation to gradually elevate each of said carrier bars onto said rail surfaces as said carrier bars are progressively moved by said conveyor members, said rail surfaces being longitudinally dimensioned between said front and rear ends so as to cause sufficient rolling engagement of each of said carrier bars for releasing the work piece therefrom prior to said support bar reaching said rear end, and said rail surfaces extending in a substantially horizontal plane disposed transverse to the path of travel of said conveyor members.

43. Apparatus in accordance with claim 40, wherein said reciprocating means comprises an outer housing having an idler support roller rotatably mounted thereon for movement of said discharge conveyor belt relative thereto, an inner housing having said outer support roller rotatably mounted thereon, a take-up support roller rotatably mounted on said inner housing for movement of said discharge conveyor belt relative thereto, mounting means for permitting reciprocation of said inner housing relative to said outer housing so as to vary the spacing between said inner and outer support rollers for varying the length of the supporting surface of said discharge conveyor belt in relationship to the position of the work piece thereon, and actuating means operatively connected to said inner housing for causing reciprocation thereof relative to said inner support roller and said outer housing.

44. Apparatus in accordance with claim 43, wherein said mounting means comprises a pair of grooves formed in said outer housing, respective ones of said grooves being adjacently disposed the spaced apart respective sides of said inner housing, and bearing means extending outwardly from each side of said inner housing for rolling engagement within said grooves, to thereby effectuate reciprocation of said inner housing relative to said outer housing.

45. Apparatus in accordance with claim 44, wherein said actuating means comprises at least one drive arm pivotally connected to said inner housing at one end thereof, linkage means connected to said drive arm on the opposite end thereof, and said linkage means being cam actuated in timed relationship to the movement of said carrier bars by said transporting means.

46. Apparatus in accordance with claim 45, wherein said linkage means comprises a first link member pivotally mounted intermediate the spaced apart ends thereof with respect to said cam, a cam follower mounted on one end of said first link member for raising and lowering the opposite end of said first link member, a second link member having one end thereof pivotally connected to said opposite end of said first link member, a third link member pivotally mounted between said first link member and said second link member, and intermediate the spaced apart ends thereof, one end of said third link member being pivotally connected to one end of said second link member, and the opposite end of said third link member being pivotally connected to the opposite end of said drive arm, whereby displacement of said cam follower is translated into reciprocating motion of said inner housing by said drive arm to provide dimensional variations in the length of said discharge conveyor belt in desired timed sequence.

47. Apparatus in accordance with claim 40, wherein said stripper means includes a plurality of elongated plates, each of said plates having an upper surface and each of said plates being mounted in one of said spaces between said belt strips, and said plates being angularly disposed relative to said belt strips so as to support the work piece thereon as said belt strips move below said upper surface of each of said plates.

48. Apparatus in accordance with claim 40, wherein said supporting means includes at least one support bar extending transversely across and below said discharge conveyor means, means for positioning said support bar behind the work piece in timed relationship with the engagement of one of said carrier bars with the rear of a work piece for removal thereof from said discharge conveyor belt, and said support bar engaging the rear of the work piece below said one of said carrier bars so as to prevent rearward displacement of the work piece as it is transported onto said carrier bar.

49. Apparatus in accordance with claim 40, wherein said drive means comprises synchronizing drive means operatively connecting the drive of said printing blanket to said removing means to cause said endless belt strips to be driven in unison with said printing blanket, and second drive means including a drive motor for effecting the drive of said removing means and said discharge means independently of said synchronizing drive means.

50. Apparatus in accordance with claim 40, including applying means for coating preselected portions of said printing blanket with an adhesive to cause the work piece to be adhesively secured to said work piece, and cleansing means mounted in operative relationship to said printing blanket to provide a washing of said printing blanket subsequent to said transfer means removing the work piece and prior to said applying means coating said printing blanket.

51. Apparatus in accordance with claim 50, wherein said applying means comprises a reservoir having an adhesive fluid contained therein, said applying means having a transfer roller rotatably mounted therewith and operable to pass through said adhesive fluid, said applying means including a doctoring blade to maintain the proper layer of said adhesive fluid upon said transfer roller, and engaging means for intermittently bringing the surface of said printing blanket into pressure engagement with said transfer roller for preselected periods of time of relative movement with respect to one another to cause predetermined segments of selected lengths of said printing blanket to be coated with said adhesive fluid for removable securement of the work piece with respect to said printing blanket.

52. Apparatus in accordance with claim 51, wherein said engaging means includes an engaging arm pivotally mounted intermediate its respective ends, said engaging arm having one end provided with a roller member mounted thereon for engagement with said printing blanket, and piston means operatively coupled to the other end of said engaging arm for displacement of said roller member to cause displacement of said printing blanket and engagement thereof with said transfer roller.

53. Apparatus for processing a work piece comprising in combination a drying tunnel, carrier bars, dryer conveyor means including a pair of spaced apart conveyor members traversing an endless path a portion of which is through said drying tunnel for drying the work piece supported on said carrier bars, releasing means operatively associated with said dryer conveyor means to cause automatic release of the work piece from its position on said carrier bars, thereby enabling the completed work piece to be received at a receiving station, said releasing means comprising a releasing rail operatively associated with each of said conveyor members, said rails being mounted in laterally fixed spaced relationship with respect to one another, said rails having a rail surface for receiving said spaced apart carrier bars thereon upon movement of said conveyor members relative to said rails, said rails having a front end and a spaced apart rear end, and said front end being contoured for raising said carrier bars above the support surface provided by said conveyor members and onto each said rail surface to cause rolling engagement of each of said carrier bars along said rail surfaces solely by frictional contact therebetween such that one end of the work piece is gradually lowered until it descends from said carrier bar on which the work piece was supportingly disposed.

54. Apparatus in accordance with claim 53, wherein said contoured front end is inclined to effect the gradual elevation of each of said carrier bars onto said rail surfaces as said carrier bars are progressively moved by said conveyor members, said rail surfaces being longitudinally dimensioned between said front and rear ends to cause sufficient rolling engagement of each of said carrier bars for releasing the work piece therefrom prior to said support bar reaching said rear end, and said rail surfaces extending in a substantially horizontal plane transverse to the path of travel of said conveyor members.

55. Apparatus for processing a work piece comprising in combination discharge means including an endless flexible discharge conveyor belt mounted upon and extending between spaced apart inner and outer support rollers, said discharge conveyor belt being capable of receiving the work piece thereon, reciprocating means operatively associated with said outer support roller for reciprocal movement of said outer support roller between extended and retracted positions which are towards and away from said inner support roller, said reciprocal movement being operative to cause the outer end of said discharge conveyor belt which extends over said outer roller to be reciprocated in timed relationship to the movement of the work piece along said discharge conveyor belt, transporting means mounted adjacent said discharge conveyor belt for movement of said carrier bars relative thereto enabling each of said carrier bars to receive a work piece thereon, said reciprocating means comprising an outer housing having an idler support roller rotatably mounted thereon for movement of said discharge conveyor belt relative thereto, an inner housing having said outer support roller rotatably mounted thereon, a take-up support roller rotatably mounted on said inner housing for movement of said discharge conveyor belt relative thereto, mounting means for permitting reciprocation of said inner housing relative to said outer housing to vary the spacing between said inner and outer support rollers for varying the length of the supporting surface of said discharge conveyor belt in relationship to the position of the work piece thereon, and actuating means operatively connected to said inner housing for providing intermittent reciprocation thereof relative to said inner support roller and said outer housing.

56. Apparatus in accordance with claim 55, wherein said mounting means comprises a pair of grooves formed in said outer housing, respective ones of said grooves being adjacently disposed the spaced apart respective sides of said inner housing, and bearing means extending outwardly from each side of said inner housing for rolling engagement within said grooves to provide reciprocation of said inner housing relative to said outer housing.

57. Apparatus in accordance with claim 56, wherein said actuating means comprises at least one drive arm pivotally connected to said inner housing at one end thereof, linkage means connected to said drive arm on the opposite end thereof, and said linkage means being cam actuated in timed relationship to the movement of said carrier bars by said transporting means.

58. Apparatus in accordance with claim 57, wherein said linkage means comprises a first link member pivotally mounted intermediate the spaced apart ends thereof with respect to said cam, a cam follower mounted on one end of said first link member for raising and lowering the opposite end of said first link member, a second link member having one end thereof pivotally connected to said opposite end of said first link member, a third link member pivotally mounted between said first link member and said second link member, and intermediate the spaced apart ends thereof, one end of said third link member being pivotally connected to one end of said second link member, and the opposite end of said third link member being pivotally connected to the opposite end of said drive arm whereby displacement of said cam follower is translated into reciprocating motion of said inner housing by said drive arm to provide dimensional variation in the length of said discharge conveyor belt in desired timed sequence.

59. Apparatus in accordance with claim 55, including control means for effecting the intermittent drive of said carrier bars, and said control means effecting the intermittent drive of said transporting means when the work piece is disposed on said discharge means in a position to be readily removed therefrom by one of said carrier bars.

60. Apparatus in accordance with claim 55, including dryer conveyor means having an endless path and being disposed adjacent one end of said transporting means for receiving said carrier bars, said dryer conveyor means including a pair of spaced apart conveyor members traversing an endless path for supporting said carrier bars having a work piece disposed thereon, and releasing means operatively associated with said dryer conveyor means to cause automatic release of the work piece from its position on said carrier bars, thereby enabling the completed work piece to be received at a receiving station.

61. Apparatus in accordance with claim 60, wherein said releasing means comprises a releasing rail operatively associated with each of said conveyor members, said rails being mounted in laterally fixed spaced relationship with respect to one another, said rails having a rail surface for receiving said spaced apart carrier bars thereon upon movement of said conveyor members relative to said rails, said rails having a front end and a spaced apart rear end, and said front end being contoured for raising said carrier bars above the support surface provided by said conveyor members and onto each said rail surface to cause rolling engagement of each of said carrier bars along said rail surfaces such that one end of the work piece is gradually lowered until it descends from said carrier bar on which the work piece was supportingly disposed.

62. Apparatus in accordance with claim 61, wherein said contoured front end is inclined to effect the gradual elevation of each of said carrier bars onto said rail surfaces as said carrier bars are progressively moved by said conveyor members, said rail surfaces being longitudinally dimensioned between said front and rear ends to cause sufficient rolling engagement of each of said carrier bars for releasing the work piece therefrom prior to said support bar reaching said rear end, and said rail surfaces extending in a substantially horizontal plane transverse to the path of travel of said conveyor members.

63. Apparatus in accordance with claim 55, including supporting means operatively mounted relative to said discharge means, said supporting means including at least one support bar extending transversely across and below said discharge conveyor belt, means for positioning said support bar behind the work piece in timed relationship with the engagement of one of said carrier bars with the rear of a work piece for removal thereof from said discharge conveyor belt, and said support bar engaging the rear of the work piece below said one of said carrier bars to prevent rearward displacement of the work piece towards the other half thereof as it is transported onto said carrier bar.

64. Apparatus in accordance with claim 63, wherein said supporting means is rotatably mounted and includes a pair of oppositely disposed support bars.

65. Apparatus for conveying a secured work piece away from an endless printing blanket having a discharge end and mounted on an intermittent drive screen printing machine, and apparatus comprising transfer means disposed adjacent to the discharge end of the movable printing blanket for effecting the movement of the work piece from said printing blanket to said transfer means, said transfer means comprising removing means including a series of spaced apart endless belt strips operatively associated with said discharge end of said printing blanket, gripping means formed on the surface of said series of spaced apart endless belt strips for gripping the work piece and peelingly stripping the work piece secured to said printing blanket to effect the transfer of the work piece from said printing blanket to said series of endless belt strips, said gripping means comprising a plurality of needle like elements disposed in a substantially vertical plane having pointed tips to define a gripping surface so as to engage and cause a pulling force to be transmitted to the work piece in the direction of travel of said printing blanket, discharge means disposed adjacent said belt strips for receiving the work piece therefrom, stripper means interposed in the spaces between said belt strips to separate and facilitate the transfer of the work piece from said belt strips to said discharge means, said stripper means including a plurality of elongated plates, each of said plates having an upper surface and respective ones of said plates being mounted in respective ones of said spaces between said belt strips, said plates being angularly disposed relative to said belt strips to support the work piece thereon as said belt strips move below said upper surface of each of said plates, and first drive means for driving said endless belt strips in timed relationship to said printing blanket such that during the relative movement therebetween said gripping means peelingly strips the work piece from said printing blanket.

66. Apparatus in accordance with claim 65, wherein said needle-like elements are inclined at an acute angle relative to the direction of travel of said endless belt strips, said acute angle is approximately 75 degrees, and said endless belt strips are substantially equidistantly spaced from one another.

67. Apparatus in accordance with claim 65, wherein said first drive means effects intermittent movement of said printing blanket, said endless belts being connected in driving relationship with said first drive means, dryer conveyor means disposed adjacent one end of said discharge means for receiving the work piece, said dryer conveyor means including a pair of spaced apart conveyor members traversing an endless path, carrier bars, said pair of spaced apart conveyer members being capable of supporting said carrier bars having a work piece disposed thereon, said discharge means comprising an endless flexible discharge conveyor belt, a pair of oppositely disposed inner and outer support rollers disposed in spaced relationship with respect to one another, said discharge conveyor belt extending between said pair of support rollers, said inner support roller being mounted in spacially fixed relationship with respect to said removing means, and reciprocating means operatively associated with said outer support roller for reciprocal movement of said outer support roller in a direction towards and away from said inner support roller in a direction towards and away from said inner support roller such that the outer end of said discharge conveyor belt which extends over said outer roller is reciprocated in timed relationship to the movement of the work piece along said discharge conveyor belt.

68. Apparatus in accordance with claim 67, including releasing means operatively associated with said dryer conveyor means so as to cause the work piece to be automatically released from its engaged position on said carrier bars, such that the completed work piece is received at a receiving station, said releasing means comprising a releasing rail operatively associated with each of said conveyor members, said rails being mounted in laterally fixed spaced relationship with respect to one another, said rails having a rail surface for receiving said spaced apart carrier bars thereon as said conveyor members move relative to said rails, said rails including a front end and a spaced apart rear end, and said front end being contoured for raising said carrier bars above the support surface provided by said conveyor members and onto each said rail surface to provide rolling engagement of each of said carrier bars along said rail surfaces such that one end of the work piece is gradually lowered until it descends from said carrier bar on which the work piece was supportingly disposed.

69. Apparatus in accordance with claim 68, wherein said reciprocating means comprises an outer housing having an idler support roller rotatably mounted thereon for movement of said discharge conveyor belt relative thereto, an inner housing having said outer support roller rotatably mounted thereon, a take-up support roller rotatably mounted on said inner housing for movement of said discharge conveyor belt relative thereto, mounting means to permit reciprocation of said inner housing relative to said outer housing so as to vary the spacing between said inner and outer support rollers for varying the length of the supporting surface of said discharge conveyor belt in relationship to the position of the work piece thereon, and actuating means operatively connected to said inner housing for causing reciprocation thereof relative to said inner support roller and said outer housing.

70. Apparatus in accordance with claim 67, including transporting means interposed between said discharge means and said dryer conveyor means, said transporting means including a series of said carrier bars disposed at spaced intervals, said transporting means controlling the movement of said carrier bars and including control means for effecting the intermittent drive of said carrier bars, and said control means effecting the intermittent drive of said transporting means when the work piece is disposed on said discharge conveyor belt in a position to be readily removed therefrom by one of said carrier bars.

71. A method of automatically removing a plurality of work pieces from an endless path movable printing blanket having a discharge end, wherein said work pieces are disposed upon the upper surface of said movable printing blanket in a predetermined orientation, comprising the steps of elevating the leading edge of the work piece away from said printing blanket so as to suspend the leading edge until the work piece is advanced a predetermined distance beyond the discharge end of said printing blanket, providing a series of spaced apart endless belt strips operatively associated with said elevating means each having a plurality of needle-like elements disposed thereon, gripping the leading edge of the work piece using said series of spaced apart endless belt strips and said needle-like elements to cause a pulling force to be transmitted to said work piece, stripping the work piece from said belt strips to effect the removal of the work piece, discharging the work piece from said belt strips to an endless flexible discharge conveyor belt mounted between spaced apart inner and outer support rollers for receiving the work piece from said belt strips, and driving said endless belt strips and said endless flexible discharge conveyor belt in timed relationship to and independently of said printing blanket.

72. The method in accordance with claim 71, wherein said step of elevating the leading edge comprises the step of directing a flow of fluid interproximally of the leading edge of the work piece and said discharge end of said printing blanket.

73. The method in accordance with claim 71, including the steps of reciprocating said outer support roller between extended and retracted positions, towards and away from said inner support roller such that the outer end of said discharge conveyor belt which extends over said outer roller is reciprocated in timed relationship to the movement of the work piece along said discharge conveyor belt, and transporting the work piece from said discharge conveyor belt to carrier bars for progressive movement through a dryer.

74. The method in accordance with claim 71, including the steps of raising and lowering of said outer support roller to cause the outer end of said discharge conveyor belt which extends over said outer roller to be raised and lowered in timed relationship to the movement of a carrier bar adapted to receive the work piece thereon, thereby enabling said carrier bar to be in a position to receive the work piece moving along said discharge conveyor belt.

75. A method of automatically removing a plurality of work pieces from an endless path movable printing blanket having a discharge end for controlled transfer to a dryer having a drying conveyor associated therewith, said work pieces being disposed upon the upper surface of said movable printing blanket in a predetermined orientation, comprising the steps of elevating the leading edge of the work piece away from said printing blanket so as to suspend the leading edge until the work piece is advanced a predetermined distance beyond the discharge end of said printing blanket, providing a series of spaced apart endless belt strips operatively associated with said elevating means, gripping the leading edge of the work piece using said series of spaced apart endless belt strips, stripping the work piece from said belt strips to effect the removal of the work piece, discharging the work piece from said belt strips to an endless flexible discharge conveyor belt mounted between spaced apart inner and outer support rollers for receiving the work piece from said belt strips, driving said endless belt strips and said endless flexible discharge conveyor belt in timed relationship to and independently of said printing blanket, reciprocating said outer support roller between extended and retracted positions, towards and away from said inner support roller such that the outer end of said discharge conveyor belt which extends over said outer roller is reciprocated in timed relationship to the movement of the work piece along said discharge conveyor belt, carrier bars, transporting the work piece from said discharge conveyor belt to said carrier bars for progressive movement through the dryer, controlling the intermittent drive of said carrier bars when said outer support roller is in its retracted position such that when the work piece is disposed upon said discharge conveyor belt in a proper position it is readily removable therefrom by one of said carrier bars, supporting the work piece in a plane extending transversely across and below said discharge conveyor means so as to engage the rear of a work piece preventing rearward displacement of the work piece as it is transported together with said carrier bar, and transferring said carrier bars having a work piece thereon to spaced apart conveyor members of the dryer conveyor.

76. The method in accordance with claim 75, including the step of releasing the work piece from its engaged position on said carrier bars, such that the completed work piece is received at a receiving station.

77. The method in accordance with claim 76, said step of releasing the work piece comprises the steps of providing a pair of rails mounted in laterally fixed spaced relationship with respect to each other and having a rail surface for receiving said spaced apart carrier bars thereon as said drying conveyor moves relative to said rails, and causing rolling engagement of each of said carrier bars along said rail surfaces such that one end of the work piece is gradually lowered until it descends from said carrier bar on which said work piece was positioned.

78. The method in accordance with claim 75, wherein said step of elevating the leading edge comprises the step of directing a flow of fluid interproximally of the leading edge of the work piece and said discharge end of said printing blanket.

79. The method in accordance with claim 75, including the steps of raising and lowering of said outer support roller to cause the outer end of said discharge conveyor belt which extends over said outer roller to be raised and lowered in timed relationship to the movement of a carrier bar adapted to receive the work piece thereon, thereby enabling said carrier bar to be in a position to receive the work piece moving along said discharge conveyor belt.

80. The method in accordance with claim 75, including the steps of feeding said carrier bars into predetermined positions at different elevational levels, and raising and lowering of said discharge conveyor belt in sequenced operation to cause said discharge conveyor belt to be pivoted into preselected positional relationship with respect to each of said elevational levels for transfer of the work piece to said carrier bars.

* * * * *